US011241079B2

(12) United States Patent
Jimenez

(10) Patent No.: US 11,241,079 B2
(45) Date of Patent: Feb. 8, 2022

(54) ORAL CARE IMPLEMENT

(71) Applicant: Colgate-Palmolive Company, New York, NY (US)

(72) Inventor: Eduardo Jimenez, Manalapan, NJ (US)

(73) Assignee: Colgate-Palmolive Company, New York, NY (US)

( * ) Notice: Subject to any disclaimer, the term of this patent is extended or adjusted under 35 U.S.C. 154(b) by 205 days.

(21) Appl. No.: 16/778,502

(22) Filed: Jan. 31, 2020

(65) Prior Publication Data

US 2021/0235854 A1 Aug. 5, 2021

(51) Int. Cl.

*A46B 9/02* (2006.01)
*A46B 9/04* (2006.01)
*A46D 1/00* (2006.01)

(52) U.S. Cl.

CPC ..... *A46B 9/025* (2013.01); *A46B 9/028* (2013.01); *A46B 9/04* (2013.01); *A46D 1/0253* (2013.01); *A46B 2200/1066* (2013.01)

(58) Field of Classification Search

CPC ..... A46B 9/025; A46B 9/028; A46B 9/04; A46B 2200/1066; A46D 1/0253

See application file for complete search history.

(56) References Cited

U.S. PATENT DOCUMENTS 2,186,005 A 1/1940 Casto
5,996,157 A * 12/1999 Smith ..... A46B 7/08 15/167.1
7,143,462 B2 12/2006 Hohlbein
7,168,125 B2 1/2007 Hohlbein
7,480,955 B2 1/2009 Hohlbein et al.
8,387,196 B2 3/2013 Jimenez et al.
8,534,769 B2 9/2013 Loetscher et al.
D780,457 S 3/2017 Jimenez et al.
9,826,822 B2 11/2017 Geiberger et al.
10,178,907 B2 1/2019 Hohlbein
10,182,644 B2 1/2019 Jimenez et al.
10,426,250 B2 10/2019 Jimenez et al.
10,455,931 B2 10/2019 Jimenez et al.
2004/0107521 A1* 6/2004 Chan ..... A46B 9/028 15/28
2005/0000048 A1* 1/2005 Hohlbein ..... A46B 9/045 15/110
2006/0080794 A1* 4/2006 Punshon ..... A46D 1/00 15/167.1
2006/0096053 A1* 5/2006 Fischer ..... A61C 17/3481 15/167.1
2006/0236478 A1* 10/2006 Hohlbein ..... A46B 15/0002 15/110
2007/0283518 A1* 12/2007 Blanchard ..... A46B 9/04 15/167.1

(Continued)

*Primary Examiner* — Weilun Lo

(57) ABSTRACT

An oral care implement and/or a cleaning element for an oral care implement. The cleaning element may include an annular cleaning component having an inner surface defining a cavity. The annular cleaning component may be formed from a plurality of arcuate portions with each of the arcuate portions extending from a first end to a second end and terminating in a distal end. A height of each of the arcuate portions may be greater at the second end than at the first end. The plurality of arcuate portions may be arranged in a ring so that the first end of each of the arcuate portions is adjacent to the second end of another one of the arcuate portions.

9 Claims, 20 Drawing Sheets

(56) References Cited

U.S. PATENT DOCUMENTS

| | | | | |
|---|---|---|---|---|
| 2009/0007357 | A1 | 1/2009 | Meadows et al. | |
| 2011/0047736 | A1 | 3/2011 | Jimenez et al. | |
| 2012/0266400 | A1 | 10/2012 | Jimenez et al. | |
| 2013/0139338 | A1* | 6/2013 | Hess | A46B 9/026 15/167.1 |
| 2014/0359956 | A1* | 12/2014 | Jungnickel | A46B 9/028 15/167.1 |
| 2016/0135578 | A1* | 5/2016 | Tschol | A46B 9/025 15/167.1 |
| 2017/0151045 | A1* | 6/2017 | Okai | A46B 9/028 |
| 2017/0354240 | A1 | 12/2017 | Jimenez et al. | |
| 2017/0354241 | A1 | 12/2017 | Jimenez et al. | |
| 2017/0367469 | A1 | 12/2017 | Jimenez et al. | |
| 2018/0008035 | A1 | 1/2018 | Jimenez et al. | |
| 2019/0110585 | A1 | 4/2019 | Hohlbein | |
| 2021/0235855 | A1* | 8/2021 | Jimenez | A46B 9/005 |

* cited by examiner

ORAL CARE IMPLEMENT

BACKGROUND

A toothbrush is used to clean the teeth by removing plaque and debris from the tooth surfaces. Conventional toothbrushes having a flat bristle trim are limited in their ability to conform to the curvature of the teeth, to penetrate into the interproximal areas between the teeth, to sweep away the plaque and debris, and to clean along the gum line. Additionally, such toothbrushes have a limited ability to retain dentifrice for cleaning the teeth. During the brushing process, the dentifrice typically slips through the tufts of bristles and away from the contact between the bristles and the teeth. As a result, the dentifrice is often spread around the mouth rather than being concentrated on the contact of the bristles with the teeth. Therefore, the efficiency of the cleaning process is reduced. While substantial efforts have been made to modify the cleaning elements of toothbrushes to improve the efficiency of the oral cleaning process, the industry continues to pursue arrangements of cleaning elements that will improve upon the existing technology. Therefore, a need exists for an oral care implement having an improved arrangement of bristles.

BRIEF SUMMARY

The present invention may be directed to an oral care implement and/or a cleaning element for an oral care implement. The cleaning element may include an annular cleaning component having an inner surface defining a cavity. The annular cleaning component may be formed from a plurality of arcuate portions with each of the arcuate portions extending from a first end to a second end and terminating in a distal end. A height of each of the arcuate portions may be greater at the second end than at the first end. The plurality of arcuate portions may be arranged in a ring so that the first end of each of the arcuate portions is adjacent to the second end of another one of the arcuate portions.

In one aspect, the invention may be an oral care implement comprising: a head having a front surface; a plurality of cleaning elements extending from the front surface of the head, the plurality of cleaning elements comprising: at least one annular cleaning component having an inner surface defining a cavity that extends along a cavity axis, the at least one annular cleaning component comprising a plurality of arcuate portions, each of the arcuate portions extending in a circumferential direction from a first end to a second end and terminating in a distal end, a height of each of the arcuate portions measured from the front surface of the head to the distal end being greater at the second end than at the first end; and wherein the plurality of arcuate portions are arranged in a ring so that the first end of each of the arcuate portions is adjacent to the second end of another one of the arcuate portions.

In another aspect, the invention may be an oral care implement comprising: a head having a front surface; a plurality of cleaning elements extending from the front surface of the head, the plurality of cleaning elements comprising: at least one cleaning component comprising an inner surface that defines a cavity and a distal end having a plurality of sloped portions, each of the sloped portions having a low point and a high point, the low point of each of the plurality of sloped portions being a portion of the sloped portion that is located closest to the front surface of the head and the high point of each of the plurality of sloped portions being a portion of the sloped portion that is located furthest from the front surface of the head; and wherein the low point of each of the plurality of sloped portions is adjacent to the high point of another one of the plurality of sloped portions.

In yet another aspect, the invention may be an oral care implement comprising: a head having a front surface; a plurality of cleaning elements extending from the front surface of the head, the plurality of cleaning elements comprising: a cleaning component having an inner surface defining a cavity, the cleaning component comprising a plurality of segments, each of the segments having a first end and a second end, each of the segments having a greater height at the second end than at the first end; and wherein the plurality of segments are arranged so that the first end of each segment is adjacent to the second end of another segment, the second end of each segment comprising an upper edge portion that protrudes from a distal end of an adjacent one of the segments, the upper edge portion of each segment being exposed.

In a further aspect, the invention may be an oral care implement comprising: a head having a front surface; a plurality of cleaning elements extending from the front surface of the head, the plurality of cleaning elements comprising: at least one cleaning component comprising an inner surface defining a cavity, the at least one cleaning component comprising a plurality of segments, each of the segments having a first end and a second end, a height of each of the segments measured from the front surface of the head to a distal end of the at least one cleaning component continually increasing from the first end to the second end; and wherein the plurality of segments of the at least one cleaning component are arranged in a loop so that the first end of each of the segments is adjacent to the second end of another one of the segments.

In a still further aspect, the invention may be a method of forming a cleaning element component on a head of an oral care implement, the method comprising: placing a first group of bristles on a front surface of a head of an oral care implement, the first group of bristles comprising a first distal end having a first low point and a first high point; placing a second group of bristles adjacent to the first group of bristles, the second group of bristles comprising a second distal end having a second low point and a second high point; placing a third group of bristles in between the first and second groups of bristles, the third group of bristles comprising a third distal end having a third low point and a third high point; and wherein the first, second, and third groups of bristles are arranged within the tuft hole so that the first high point is adjacent to the second low point, the second high point is adjacent to the third low point, and the third high point is adjacent to the first low point.

In yet another aspect, the invention may be an oral care implement comprising: a head having a front surface; a plurality of cleaning elements extending from the front surface of the head, the plurality of cleaning elements comprising: a first annular cleaning component comprising a first inner surface defining a first cavity, the first annular cleaning component having a first distal end that is sloped from a first low point to a first high point; a second annular cleaning component comprising a second inner surface defining a second cavity, the second annular cleaning component having a second distal end that is sloped from a second low point to a second high point; and wherein the first annular cleaning component is located within the second cavity of the second annular cleaning component, and wherein the first and second distal ends are sloped in opposite directions.

In another aspect, the invention may be an oral care implement comprising; a head having a front surface; a plurality of cleaning elements extending from the front surface of the head, the plurality of cleaning elements comprising: at least one annular cleaning component comprising an inner surface defining a cavity that extends along a cavity axis and an annular distal end, the annular distal end comprising a first portion extending circumferentially from a first end to a second end and a second portion that extends between the first and second ends of the first portion, the first portion lying in a plane and the second portion being: (1) located on a first side of the plane between the plane and the front surface of the head; or (2) located on a second side of the plane that is opposite the first side of the plane.

In a further aspect, the invention may be an oral care implement comprising: a head having a front surface; a plurality of cleaning elements extending from the front surface of the head, the plurality of cleaning elements comprising: a first annular cleaning component comprising a first inner surface defining a first cavity and a first distal end; a second annular cleaning component surrounding the first annular cleaning component, the second annular cleaning component comprising a second inner surface defining a second cavity and a second distal end having a non-planar stepped profile.

In a still further aspect, the invention may be an oral care implement comprising: a head having a front surface; a plurality of cleaning elements extending from the front surface of the head, the plurality of cleaning elements comprising: at least one cleaning component comprising a distal end and an inner surface defining a cavity, the distal end comprising a plurality of sloped portions, each of the sloped portions extending from a low point to a high point, and wherein the low point of each one of the sloped portions is immediately adjacent to the high point of another one of the sloped portions.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
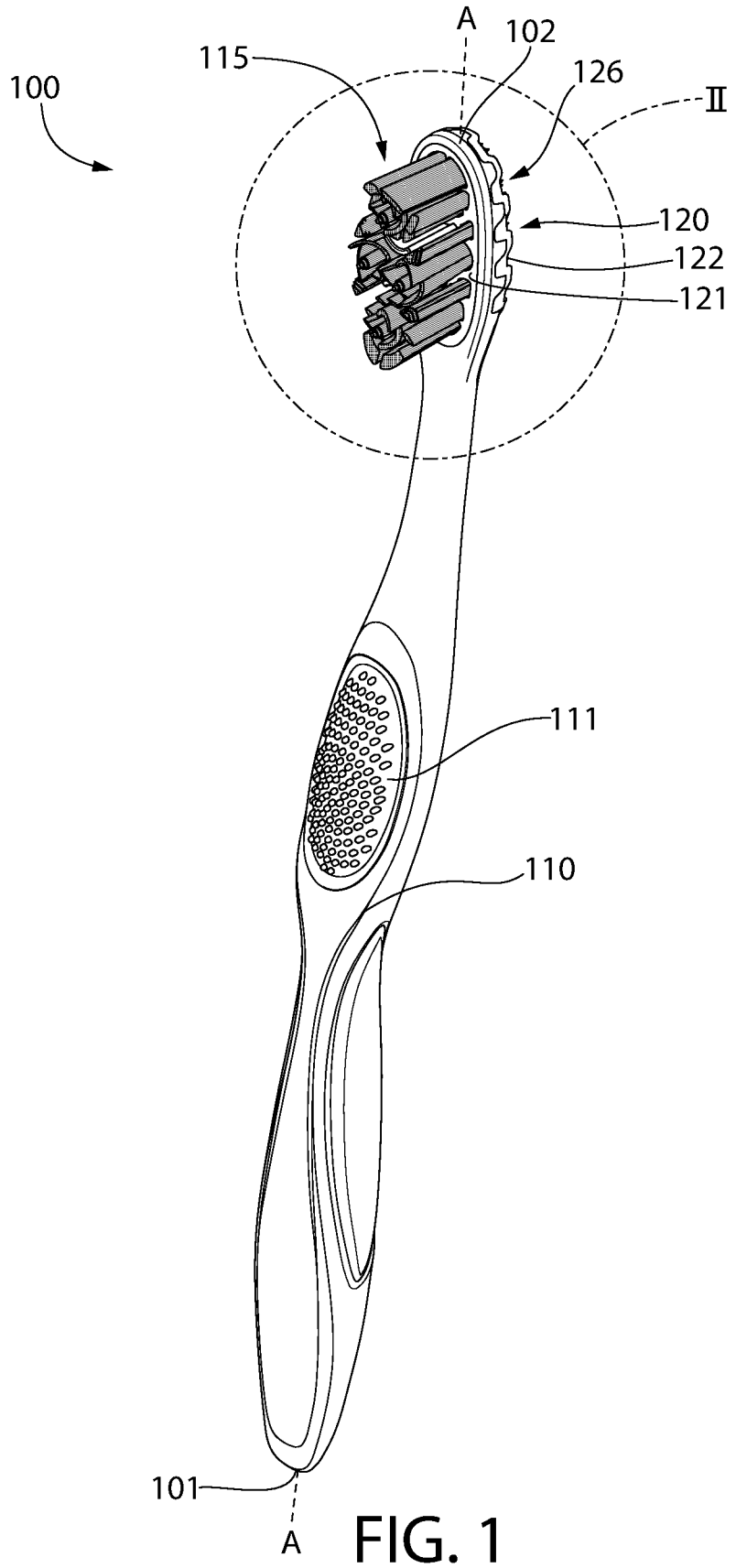
FIG. 1 is a perspective view of an oral care implement in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring first to FIG. 1, an oral care implement 100 is illustrated in accordance with an embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement extends from a proximal end 101 to a distal end 102 along a longitudinal axis A-A. The oral care implement 100 generally comprises a handle 110 and a head 120. The handle 110 is an elongated structure that provides the mechanism by which the user can hold and manipulate the oral care implement 100 during use. In the exemplified embodiment, the handle 110 is depicted having various contours for user comfort. Of course, the invention is not to be limited by the specific shape illustrated for the handle 110 in all embodiments and in certain other embodiments the handle 110 can take on a wide variety of shapes, contours, and configurations, none of which are limiting of the present invention unless so specified in the claims.

In the exemplified embodiment, the handle 110 is formed of a rigid plastic material, such as for example without limitation polymers and copolymers of ethylene, propylene, butadiene, vinyl compounds, and polyesters such as polyethylene terephthalate. Furthermore, the handle 110 may include a resilient material, such as a thermoplastic elastomer, as a grip cover 111 that is molded over portions of or the entirety of the handle 110 to enhance the gripability of the handle 110 during use. For example, portions of the handle 110 that are typically gripped by a user's palm during use may be overmolded with a thermoplastic elastomer or other resilient material to further increase comfort to a user. Furthermore, materials other than those noted above can be used as the base material for the handle 110, including without limitation metal, wood or any other desired material that has sufficient structural rigidity to permit a user to grip the handle 110 and manipulate the oral care implement 100 during toothbrushing.

The head 120 of the oral care implement 100 is coupled to the handle 110 and comprises a front surface 121 and an opposing rear surface 122. In the exemplified embodiment, the head 120 is formed integrally with the handle 110 as a single unitary structure using a molding, milling, machining, or other suitable process. However, in other embodiments the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. In still other embodiments, the head 120 may be formed as a part of a refill or replacement structure that can be detachably coupled to the handle 110 and removed for replacement as needed. In any of those scenarios, the head 120 is still deemed to be coupled to the handle 110. The head 120 may, in certain embodiments, be formed of any of the rigid plastic materials described above as being used for forming the handle 110, although the invention is not to be so limited in all embodiments and other materials that are commonly used during toothbrush head manufacture may also be used.

The oral care implement 100 also comprises a plurality of tooth cleaning elements 115 extending from the front surface 121 of the head 120. The details of certain ones of the plurality of tooth cleaning elements 115 will be discussed below, including specific details with regard to structure, pattern, orientation, and material of such tooth cleaning elements 115. However, where it does not conflict with the other disclosure provided herein, it should be appreciated that the term "tooth cleaning elements" may be used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Thus, any combination of these tooth cleaning elements may be used within the tooth cleaning elements 115 in some embodiments. However, as described herein below, in certain embodiments one or more of the tooth cleaning elements 115 may be formed as tufts of bristles.

In embodiments that use elastomeric elements as one or more of the tooth cleaning elements 115, suitable elastomeric materials may include any biocompatible resilient material suitable for uses in an oral hygiene apparatus. To provide optimum comfort as well as cleaning benefits, the elastomeric material of any such tooth or soft tissue engaging elements may have a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Figure 4:
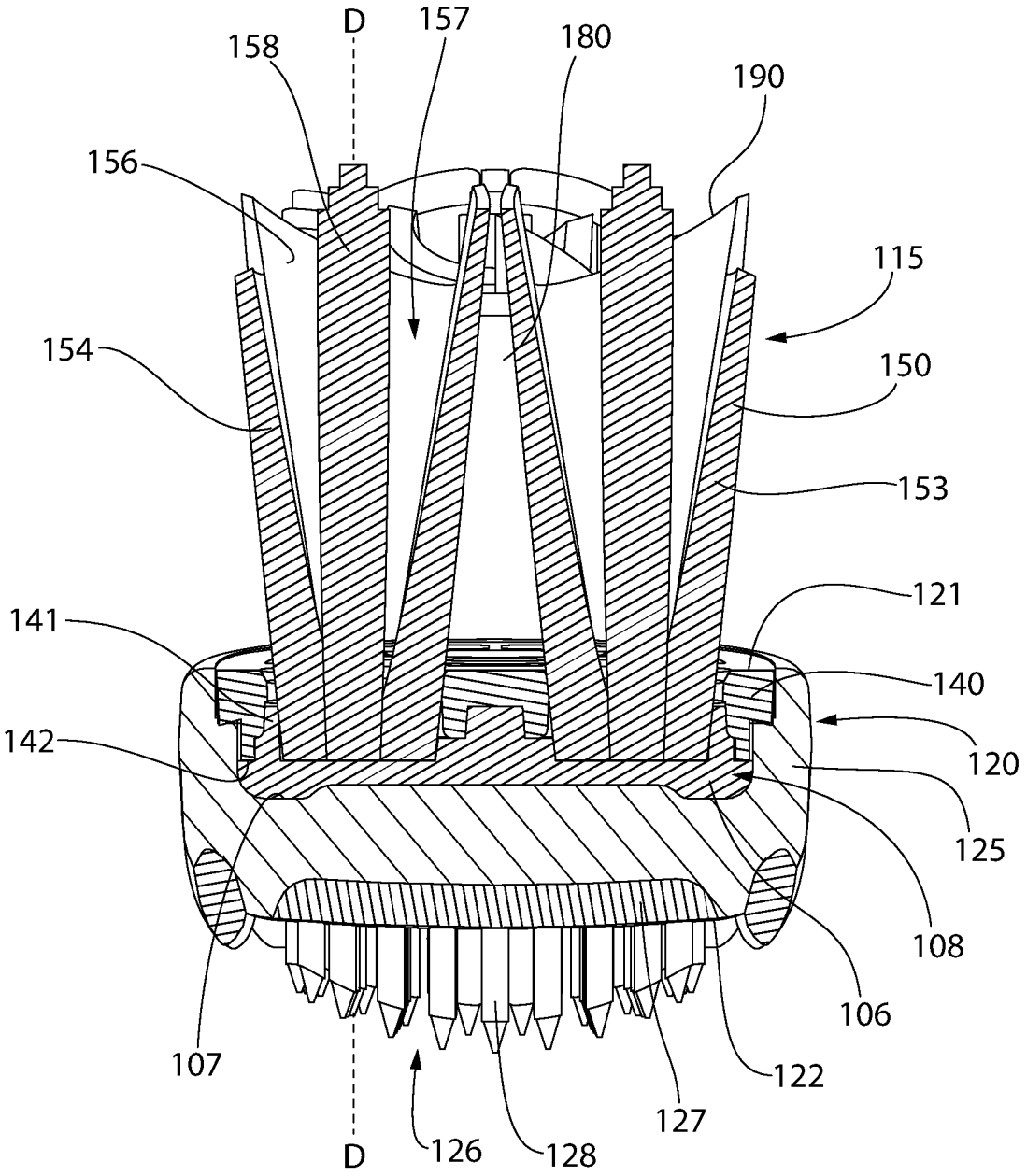
FIG. 4 is a cross-sectional area taken along line IV-IV of FIG. 3.

Referring to FIGS. 1 and 4 concurrently, one manner in which the tooth cleaning elements 115 are secured to the head 120 will be described. Specifically, in the exemplified embodiment the tooth cleaning elements 115 are formed as a cleaning element assembly on a head plate 140 such that one or more of the tooth cleaning elements 115 are mounted onto the head plate 140 and then the head plate 140 is coupled to the head 120. In such an embodiment, the head plate 140 is a separate and distinct component from the head 120 of the oral care implement 100. However, the head plate 140 is connected to the head 120 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 140 and the head 120 are separately formed components that are secured together during manufacture of the oral care implement 100. The head 120 may be deemed to comprise a base structure 125 and the head plate 140 in some embodiments.

In certain embodiments, the head plate 140 may comprise a plurality of holes or tuft holes 141 formed therethrough, and the tooth cleaning elements 115 may be mounted to the head plate 140 within the holes 141. This type of technique for mounting the tooth cleaning elements 115 to the head 120 via the head plate 140 is generally known as anchor free tufting (AFT). Specifically, in AFT a plate or membrane (i.e., the head plate 140) is created separately from the base structure 125 of the head 120. The tooth cleaning elements 115 (such as bristles, elastomeric elements, and combinations thereof) are positioned into the head plate 140 so as to extend through the holes 141 of the head plate 140. The free ends of the tooth cleaning elements 115 on one side of the head plate 140 perform the cleaning function. The ends of the tooth cleaning elements 115 on the other side of the head plate 140 are melted together by heat to be anchored in place. As the tooth cleaning elements 115 are melted together, a melt matte 106 is formed. After the tooth cleaning elements 115 are secured to the head plate 140, the head plate 140 is secured to the base structure 125 of the head 120 such as by ultrasonic welding. When the head plate 140 is coupled to the base structure 125 of the head 120, the melt matte 106 is located between a lower surface 142 of the head plate 140 and a floor 107 of a basin 108 of the base structure 125 of the head 120 in which the head plate 140 is disposed. The melt matte 106, which is coupled directly to and in fact forms a part of the tooth cleaning elements 115, prevents the tooth cleaning elements 115 from being pulled through the holes 141 in the head plate 140 thus ensuring that the tooth cleaning elements 105 remain attached to the head plate 140 during use of the oral care implement 100.

In another embodiment, the tooth cleaning elements 115 may be connected to the head 120 using a technique known in the art as AMR. In this technique, the handle is formed integrally with the head plate as a one-piece structure. After the handle and head plate are formed, the bristles are inserted into holes in the head plate so that free/cleaning ends of the bristles extend from the front surface of the head plate and bottom ends of the bristles are adjacent to the rear surface of the head plate. After the bristles are inserted into the holes in the head plate, the bottom ends of the bristles are melted together by applying heat thereto, thereby forming a melt matte at the rear surface of the head plate. The melt matte is a thin layer of plastic that is formed by melting the bottom ends of the bristles so that the bottom ends of the bristles transition into a liquid, at which point the liquid of the bottom ends of the bristles combine together into a single layer of liquid plastic that at least partially covers the rear surface of the head plate. After the heat is no longer applied, the melted bottom ends of the bristles solidify/harden to form the melt matte/thin layer of plastic. In some embodiments, after formation of the melt matte, a tissue cleaner is injection molded onto the rear surface of the head plate, thereby trapping the melt matte between the tissue cleaner and the rear surface of the head plate. In other embodiments, other structures may be coupled to the rear surface of the head plate to trap the melt matte between the rear surface of the head plate and such structure without the structure necessarily being a tissue cleaner (the structure can just be a plastic material that is used to form a smooth rear surface of the head, or the like).

In still other embodiments, a technique known as PTt can be used. This process includes: end-rounding the bristle filaments and arranging them in a desired tuft pattern; melting the individual filaments together to form tufts that have a mushroom shaped end; inserting the tufts into pre-cored holes of a toothbrush handle/head; and applying pressure and heat for a pre-determined period of time so that the surface of the brush head shapes itself to enclose the mushroom-shaped ends of the tufts, thereby holding them firmly in the head.

Of course, techniques other than AFT, AMR, and PTt can be used for mounting the tooth cleaning elements 115 to the head 120, such as widely known and used stapling techniques or the like. In such embodiments the head plate 140 may be omitted and the tooth cleaning elements 115 may be coupled directly to the head 120. Furthermore, in a modified version of the AFT process discussed above, the head plate 140 may be formed by positioning the tooth cleaning elements 115 within a mold, and then molding the head plate 140 around the tooth cleaning elements 115 via an injection molding process.

Still referring to FIGS. 1 and 4, in certain embodiments the oral care implement 100 may also include a soft tissue cleanser 126 coupled to or positioned on the rear surface 122 of the head 120. The soft tissue cleanser 126 may be formed of a thermoplastic elastomer or other rubber-like or resilient material. The soft tissue cleanser 126 may comprise a pad portion 127 that is disposed within a basin cavity on the rear surface 122 of the head 120 and a plurality of protuberances 128 that extend from an exposed surface of the pad portion 127. Of course, there may be no basin cavity in other embodiments and the pad portion 127 may instead be affixed directly to the rear surface 122 of the head 120. An example of a suitable soft tissue cleanser that may be used with the present invention and positioned on the rear surface of the head 120 is disclosed in U.S. Pat. No. 7,143,462, issued Dec. 5, 2006 to the assignee of the present application, the entirety of which is hereby incorporated by reference. The protuberances 128 may take the form of elongated ridges, nubs, or combinations thereof. Of course, the invention is not to be so limited and in certain embodiments the oral care implement 100 may not include any soft tissue cleanser.

Figure 2:
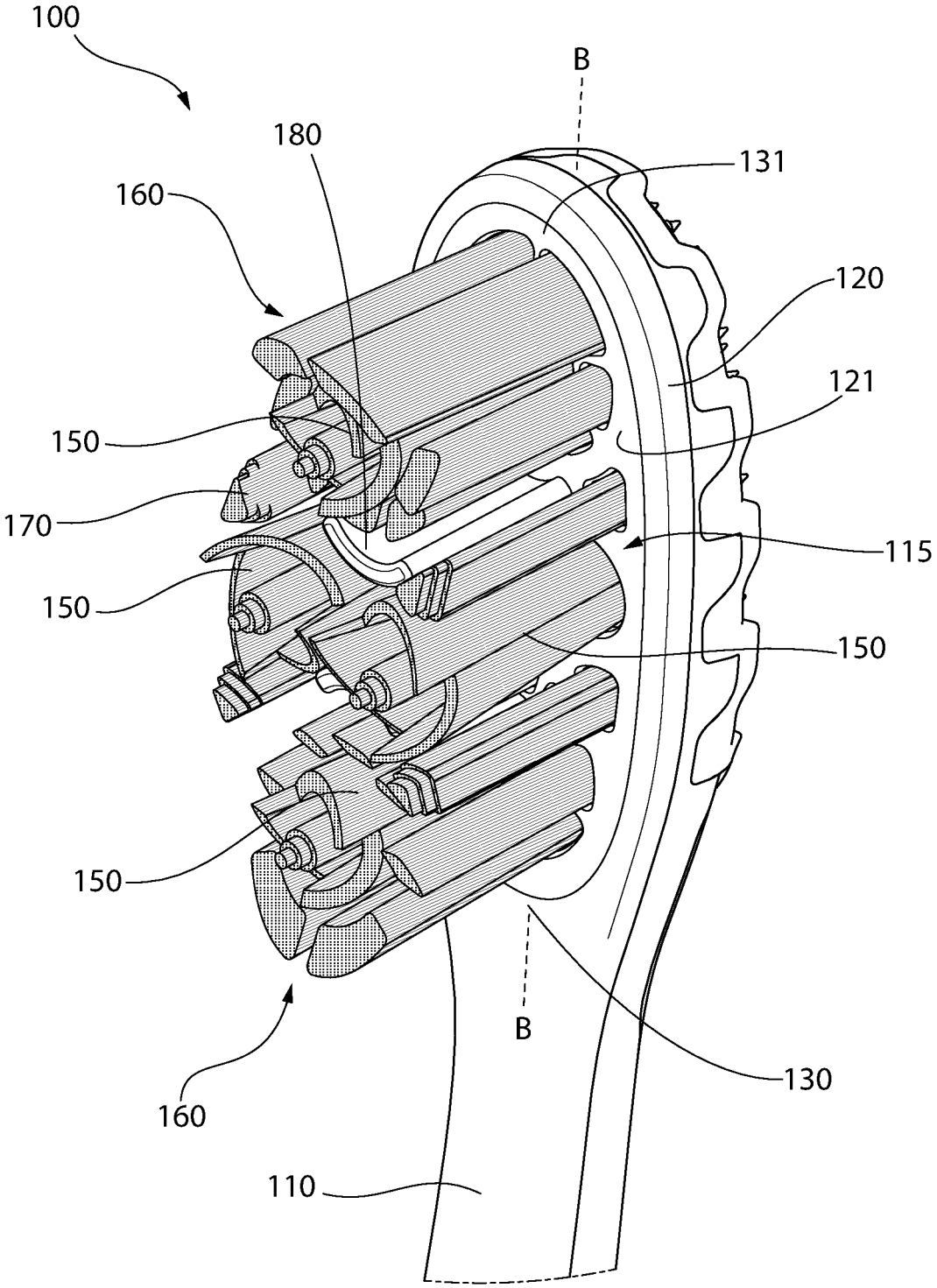
FIG. 2 is a close-up view of area II of FIG. 1 showing a head of the oral care implement.
Figure 3:
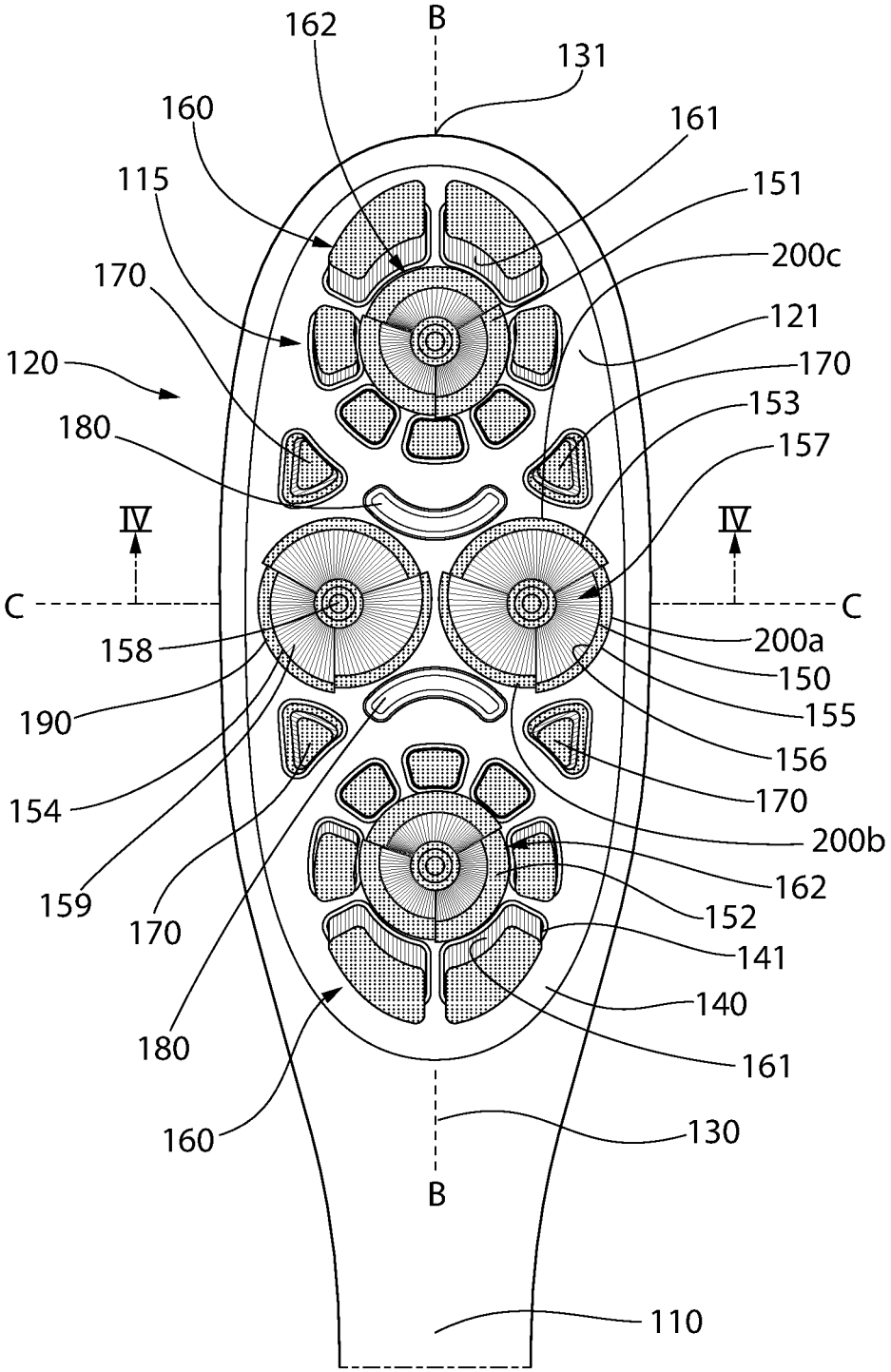
FIG. 3 is a front view of the head of the oral care implement of FIG. 1.

Referring to FIGS. 2-4, the different formations, structures, shapes, and the like of the plurality of tooth cleaning elements 115 will be described, with additional details of some of the tooth cleaning elements 115 being provided below with reference to FIGS. 6-8E. Furthermore, details for other tooth cleaning elements in accordance with additional or alternative embodiments will be provided later on in this document with reference to FIGS. 9A-12B. Not all of the tooth cleaning elements shown in the drawings will be described herein. Thus, it should be appreciated that the invention described herein may be directed to an oral care implement having any of one or more of the tooth cleaning elements shown in the drawings and described herein. Variations to the overall bristle pattern and configuration may still fall within the scope of the invention set forth herein and specified in the claims.

The head 120 of the oral care implement 100 extends from a proximal end 130 (which is adjacent to the handle 110) to a distal end 131 along a longitudinal axis B-B. As mentioned previously, the plurality of tooth cleaning elements 115 extend from the front surface 121 of the head 120. The plurality of tooth cleaning elements 115 are generally disposed within the tuft holes 141 formed into the head 120 (or the head plate 140 thereof).

The plurality of tooth cleaning elements 115 comprise at least one first cleaning component 150 having a structure that will be described later with reference to FIGS. 4-7. More specifically, in the exemplified embodiment there are a plurality of the first cleaning components 150 including a distal cleaning component 151 located on the longitudinal axis B-B at the distal end 131 of the head 120, a proximal cleaning component 152 located on the longitudinal axis B-B at the proximal end 130 of the head 120, a first central cleaning component 153 and a second central cleaning component 154 located along a transverse axis C-C that is perpendicular to the longitudinal axis B-B. The first and second central cleaning components 153, 154 are located on opposite sides of the longitudinal axis A-A and the distal and proximal cleaning components 151, 152 are located on opposite sides of the transverse axis C-C. The first and second central cleaning components 153, 154 are located between the proximal and distal cleaning components 151, 152 in the exemplified embodiment. Of course, there is merely the configuration for one particular embodiment, and different numbers of the first cleaning component 150 may be used in other embodiments. For example, there may be just one of the first cleaning components 150, or two of the first cleaning components 150, or any number of the first cleaning components 150 that can fit on the head 120 positioned at desirable locations along the head 120 for enhanced tooth cleaning.

Each of the first cleaning components 150 has a similar structure, and thus the numbering as it relates to the structure and features of the first cleaning components 150 may only be shown in the drawings for one of the first cleaning components 150 to avoid clutter. The first cleaning components 150 comprise an outer surface 155 and an inner surface 156, with the inner surface 156 defining or surrounding a cavity 157. In the exemplified embodiment, the cavity 157 extends along a cavity axis D-D that is perpendicular to the front surface 121 of the head 120. Of course, the cavity axis D-D may be angled obliquely relative to the front surface 121 of the head 120 in some alternative embodiments. The cavity 157 may be an empty space that is surrounded by the inner surface 156 of the first cleaning component 150. The cavity 157 may have a conical shape. Specifically, in the exemplified embodiment the cavity 157 has a transverse cross-sectional area that increases with increasing distance from the front surface 121 of the head 120 towards a distal end 190 of the first cleaning component 150. However, the invention is not to be so limited in all embodiments and the cavity 157 may have other shapes in other embodiments. For example, the cavity 157 may have a cylindrical shape in some embodiments whereby it has a constant transverse cross-sectional area regardless of the distance from the front surface 121 of the head 120 at which the transverse cross-section is taken.

In the exemplified embodiment, there is a single central cleaning element 158 located within the cavity 157 of each of the first cleaning components 150. In the exemplified embodiment, a space or gap remains between the inner surface 156 of the first cleaning component 150 and the central cleaning element 158 located in the cavity 157. However, the invention is not to be so limited in all embodiments and the cavity 157 may be completely filled with one or more cleaning elements in some embodiments. Furthermore, in the exemplified embodiment the central cleaning element 158 has a greater height than a maximum height of the first cleaning component 150, although in other embodiments the central cleaning element 158 may be shorter than the maximum height of the first cleaning component 150.

It is noted that if the cavity 157 were to be entirely filled with cleaning elements, it may appear as if the cleaning elements within the cavity 157 and the first cleaning component 150 form a singular cleaning component. This may be particularly true in embodiments whereby the first cleaning component 150 and the central cleaning element 158 are disposed within the same tuft hole. However, in such a variation, an outer ring of the cleaning elements may form the first cleaning component 150 with the cleaning element (s) located within the outer ring of the cleaning elements forming the central cleaning element(s) 158. The first cleaning component 150 may be distinguishable from the central cleaning element 158 based on color in some embodiments, although this is not required in all embodiments.

In the exemplified embodiment, each of the first cleaning components 150 is annular or ring-shaped. Thus, in some embodiments the first cleaning components 150 are referred to as annular cleaning components. As used in this regard, the term "annular" is not limited to being round or circular in all embodiments. Rather, the term "annular" is intended to include any closed-loop geometry or shape that surrounds an interior cavity. Thus, although in the exemplified embodiment the first cleaning components 150 have round or ring-like transverse cross-sectional shapes, in other embodiments the first cleaning components 150 could be square, rectangular, oval, triangular, or other shapes, all of which is intended to be included within the meaning of the term annular as used herein.

In the exemplified embodiment, each of the first cleaning components 150 comprises a plurality of bristles 159 that are arranged within a single one of the tuft holes 141 formed into the front surface 121 of the head 120. Furthermore, in the exemplified embodiment the first cleaning components 150 and the central cleaning elements 158 located within the cavity 157 of the first cleaning component 150 are disposed within a single tuft hole 141. However, the invention is not to be so limited in all embodiments. First, in some embodiments one or more of the first cleaning components 150 may be formed from an elastomeric material rather than from bristles (such as a thermoplastic elastomer, a thermoplastic polyurethane, or the like). Furthermore, in some embodiments one or more of the first cleaning components 150 may be formed from separate members that are each disposed within a different tuft hole. Thus, the annular shape of the first cleaning components 150 may be formed by the arrangement of the separate members in their separate tuft holes rather than from the members being disposed within a singular tuft hole. The details of the arrangement of the first cleaning components 150 in accordance with the exemplary embodiment will be provided below with reference to FIGS. 5-8E.

Figure 5:
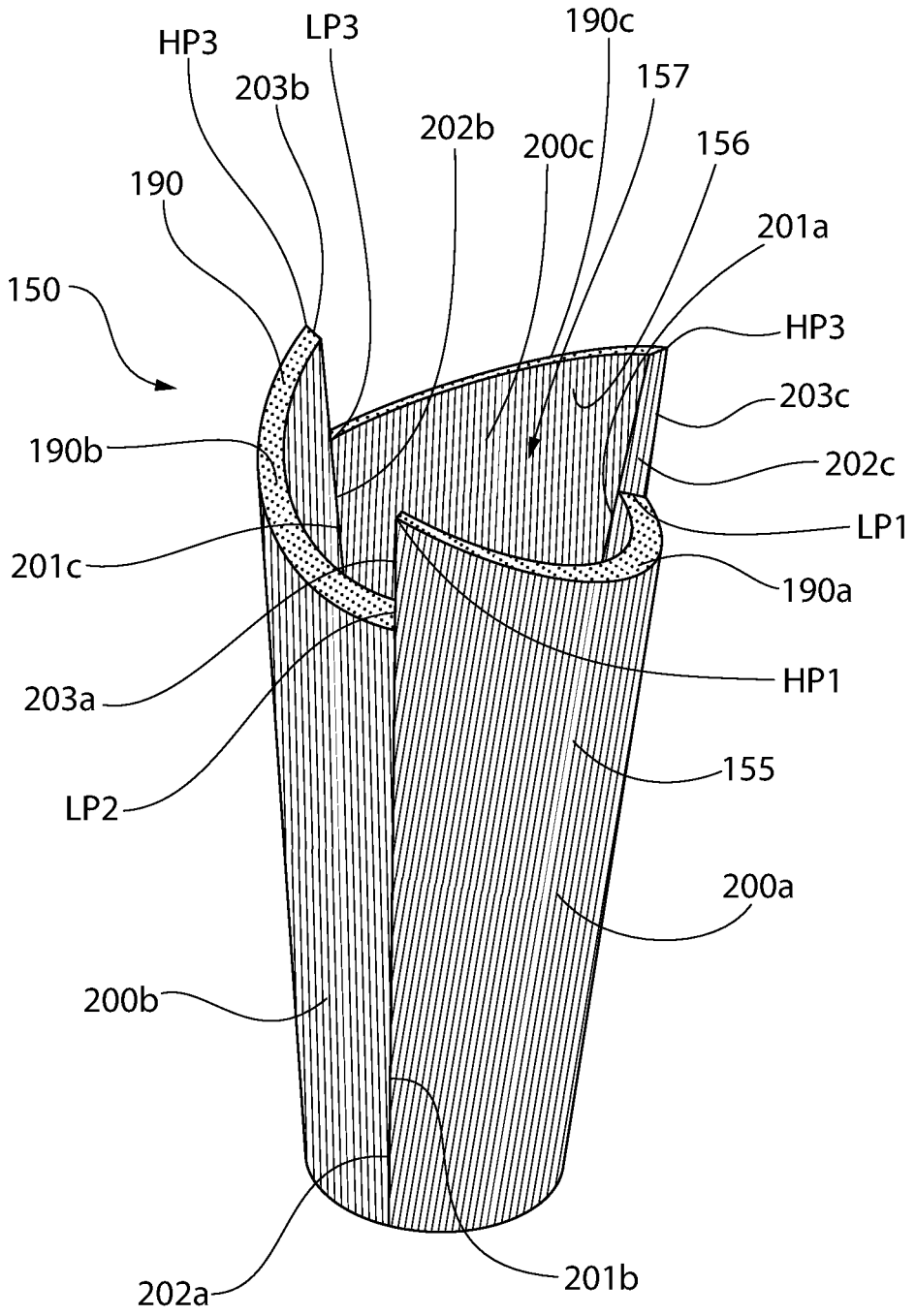
FIG. 5 is a perspective view of a cleaning component of the oral care implement of FIG. 1.
Figure 6:
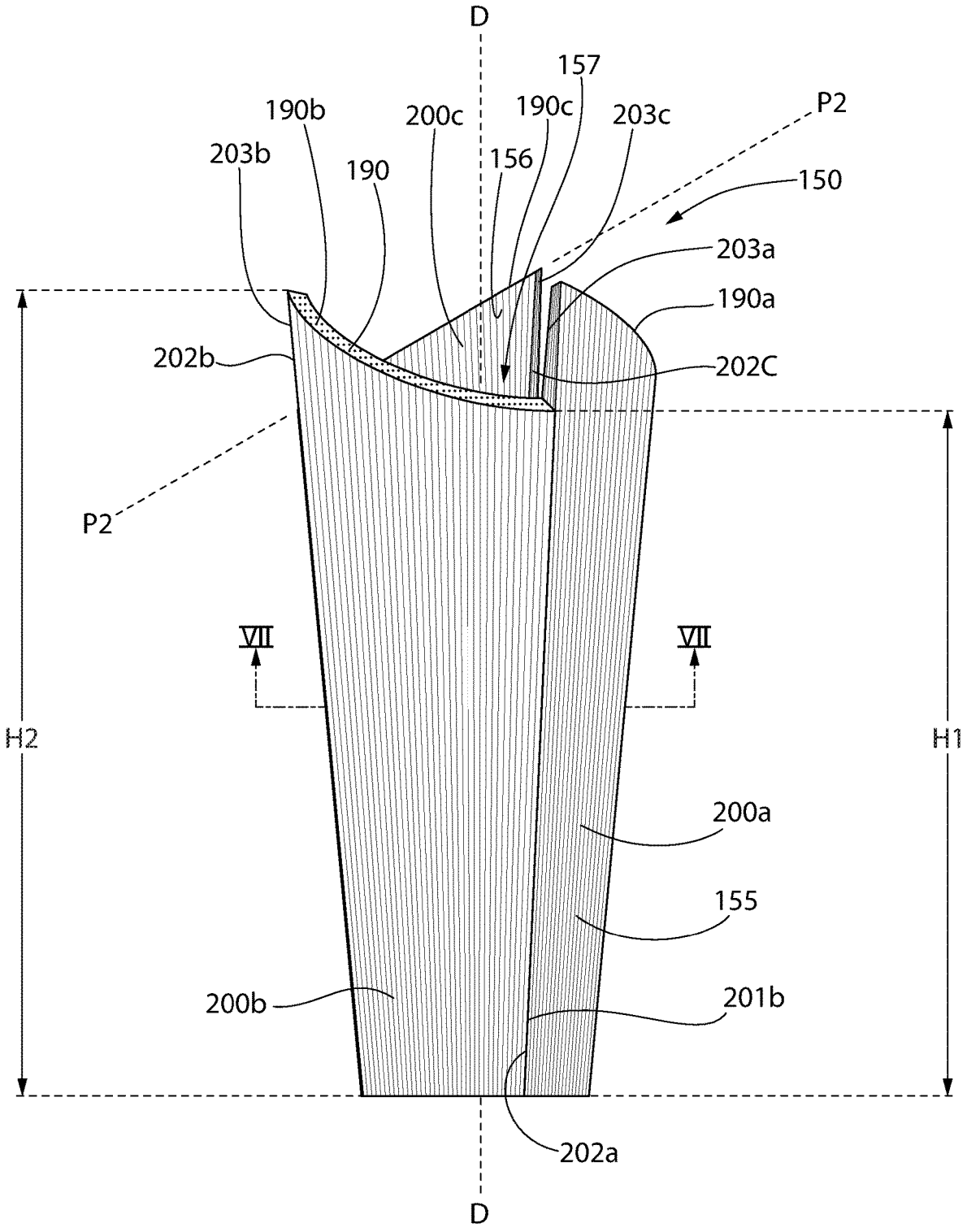
FIG. 6 is a front view of the cleaning component of FIG. 5.

In addition to the first cleaning components 150, which will be described in greater detail below with reference to FIGS. 5-7, in the exemplified embodiment the plurality of tooth cleaning elements 115 comprises two second cleaning element components 160, four side bristle tufts 170, and two arcuate cleaning elements 180. In the exemplified embodiment the two arcuate cleaning elements 180 are tufts of bristles, although they could be formed from an elastomeric material in other embodiments. The two arcuate cleaning elements 180 are arranged on the longitudinal axis B-B of the head 120. A first one of the arcuate cleaning elements 180 is adjacent to the proximal cleaning component 152 and has a concave side facing the proximal cleaning component 152. A second one of the arcuate cleaning elements 180 is adjacent to the distal cleaning component 151 and has a concave side facing the distal cleaning component 151. The convex sides of the arcuate cleaning elements 180 face each other and face the first and second central cleaning components 153, 154.

In the exemplified embodiment, the four side bristle tufts 170 are formed as a tuft of bristles having a triangular transverse cross-sectional shape. However, in other embodiments one or more of the four side bristle tufts 170 may have different shapes, such as having circular, square, rectangular, ovular, or the like transverse cross-sectional shapes. The four side bristle tufts 170 are positioned adjacent to the side edges of the head 120. Furthermore, the four side bristle tufts 170 are arranged collectively in a rectangular arrangement that surrounds the two arcuate cleaning elements 180 and the first and second central cleaning components 153, 154.

As mentioned above, there are also two second cleaning components 160. One of the second cleaning components 160 surrounds the proximal cleaning component 152 and the other of the second cleaning components 160 surrounds the distal cleaning component 151. In this embodiment, each of the second cleaning components 160 comprises a plurality of tufts of bristles that are arranged in a ring or loop that surrounds one of the first cleaning components 150. Thus, the second cleaning components 160 have an inner surface 161 that defines a cavity 162 within which one of the first cleaning components 150 is located. More specifically, in the exemplified embodiment one of the second cleaning components 160 surrounds the proximal cleaning component 152 and the other of the second cleaning components 160 surrounds the distal cleaning component 151.

In the exemplified embodiment, the second cleaning components 160 are distinguishable from the first cleaning components 150 in that the second cleaning components 160 comprise a plurality of separate tufts of bristles each located in its own tuft hole whereas the first cleaning components 150 comprise a single tuft of bristles located in a single tuft hole. Thus, while the ring or loop formed by the first cleaning component 150 is free of gaps, the ring or loop formed by the second cleaning component 160 has gaps in the spaces between the distinct tufts that form the second cleaning component 160. However, in other embodiments the first and second cleaning components 150, 160 could both be formed in a single tuft hole, or the first and second cleaning components 150, 160 could both be formed in multiple tuft holes, or the first cleaning component 150 could be formed in a multiple tuft holes while the second cleaning component 160 is formed in a single tuft hole. Thus, variations to that which is shown in the exemplified embodiment may fall within the scope of the invention set forth herein.

Figure 7:
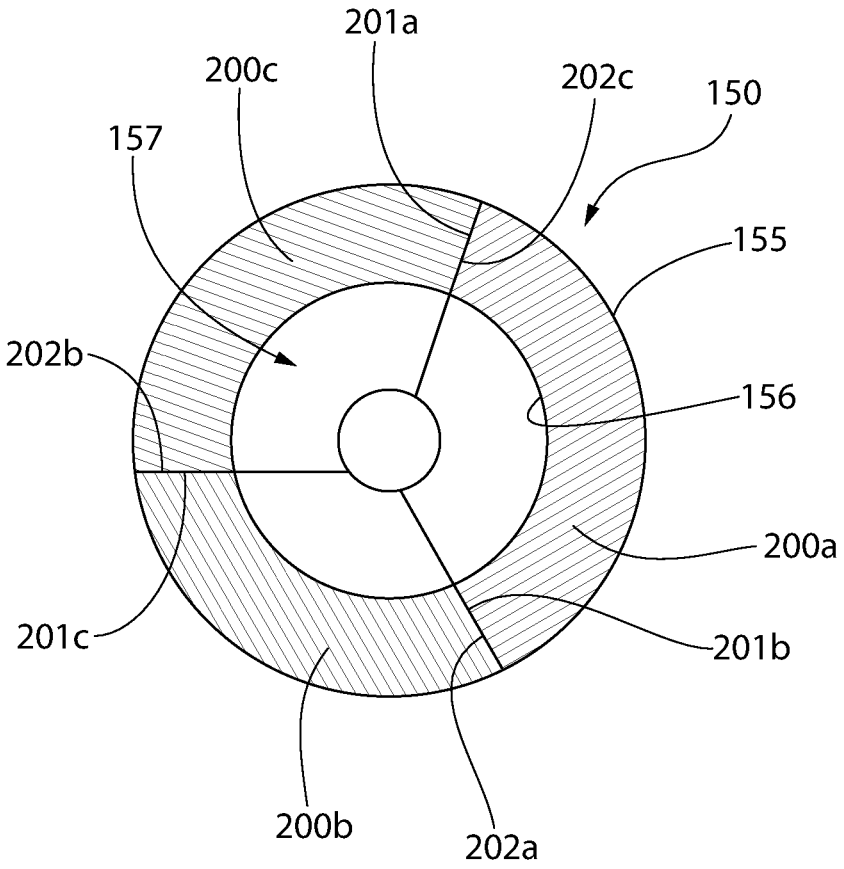
FIG. 7 is a cross-sectional view taken along line VII-VII of FIG. 6.

Referring now to FIGS. 3 and 5-7, the first cleaning component 150 will be described in greater detail. As mentioned above, in the exemplified embodiment the first cleaning component 150 has an annular or ring-like shape. More specifically, the outer and inner surfaces 155, 156 of the first cleaning component 150 are both circular, as best shown in FIG. 7. Of course, the outer and inner surfaces 155, 156 could be oval, square, rectangular, or the like depending on the overall shape of the first cleaning component 150 as described herein, all of which is encompassed by the term annular as noted above. The outer surface 155 of the first cleaning component 150 is a smooth, continuous, and flush surface. Similarly, the inner surface 155 of the first cleaning component 150 is a smooth, continuous, and flush surface. Thus, there are generally no shoulders or edges on or protruding from the inner or outer surfaces 155, 156 (although some roughened areas or protruding features may be formed along the inner and/or outer surfaces 155, 156 after several uses of the oral care implement 100 as the bristles of the first cleaning component 150 splay as a result of normal wear and tear).

As mentioned previously, the first cleaning component 150 extends from the front surface 121 of the head 120 to the distal end 190. The distal end 190 is the terminal end of the first cleaning component 150 and may also be referred to as a distal surface, a top surface, or an annular top surface due to the annular shape of the distal end 190 in accordance with the exemplified embodiment. The first cleaning component 150 forms a continuous bristle wall that is free of any gaps therein. Thus, as seen for example in FIG. 6, there is no direct line of sight through the first cleaning component 150 from the outer surface 155 to the inner surface 156 or through the outer surface and into the cavity 157. The bristles that form the first cleaning component 150 in the exemplified embodiment are packed sufficiently tight together to ensure that there are no gaps therein. Moreover, if the first cleaning component 150 were formed from an elastomeric material, it would also have no openings or holes in its sidewall. Thus, the only passageway into the cavity 157 is through an opening located at the distal end 190 of the first cleaning component 150.

The first cleaning component 150 comprises a plurality of portions 200*a-c*, with each of the portions 200*a-c* forming a segment or section of the continuous wall. Thus, each of the portions 200*a-c* of the first cleaning component 150 extends from the front surface 121 of the head 120 to the distal end 190 such that each of the portions 200*a-c* of the first cleaning component 150 comprises a portion of the distal end 190 of the first cleaning component 150. In the exemplified embodiment, due to the annular shape of the first cleaning component 150, each of the plurality of portions 200*a-c* is arcuate in shape and may be referred to as an arcuate portion of the first cleaning component 150. However, the invention is not to be so limited and the portions could be linear in other embodiments, particularly in embodiments whereby the first cleaning component 150 has a polygonal cross-sectional shape. The portions could also be wavy or have other shapes as dictated by the overall shape of the first cleaning component 150. Moreover, in the exemplified embodiment there are three of the plurality of portions 200*a-c* comprising a first portion 200*a*, a second portion 200*b*, and a third portion 200*c*. However, there could be two of the portions in some embodiments, and there could be more than three of the portions in other embodiments.

Each of the portions 200*a-c* has a first end 201*a-c* and a second end 202*a-c*, with each of the first and second ends 201*a-c*, 202*a-c* extending in a generally vertical direction (plus or minus 10° from perpendicular to the front surface 121 of the head 120) between the distal end 190 of the first cleaning component 150 and the front surface 121 of the head 120. Thus, where the first cleaning component 150 is annular and round as with the exemplified embodiment, each of the portions 200*a-c* extends in a circumferential direction from the first end 201*a-c* to the second end 202*a-c*. In any case, regardless of the shape of the first cleaning component 150, each of the first, second, and third portions 200*a-c* of the first cleaning component 150 extend from the first end 201*a-c* to the second end 202*a-c* when moving around the exterior of the first cleaning component 150.

The first portion 200*a* of the first cleaning component 150 comprises a first portion 190*a* of the distal end 190 of the first cleaning component 150, the second portion 200*b* of the first cleaning component 150 comprises a second portion 190*b* of the distal end 190 of the first cleaning component 150, and the third portion 200*c* of the first cleaning component 150 comprises a third portion 190*c* of the distal end 190 of the first cleaning component 150. Each of the first, second, and third portions 190*a-c* of the distal end 190 forms the distal end of that particular one of the first, second, and third portions 200*a-c* of the first cleaning component 150.

Each of the first, second, and third portions 200*a-c* of the first cleaning component 150 has a height that varies when moving from the first end 201*a-c* to the second end 202*a-c*. Specifically, the height of the first, second, and third portions 200*a-c* of the first cleaning component 150 may be measured from the front surface 121 of the head 120 or from a bottom end 149 of the first cleaning component 150 to the first, second, and third portions 190*a-c* of the distal end 190 of the first cleaning component 150, respectively. The height of each of the first, second, and third portions 200*a-c* of the first cleaning component 150 is greater at the second end 202*a-c* than at the first end 201*a-c*. Thus, for example, the second portion 200*b* of the first cleaning component 150 may have a first height H1 measured from the bottom end 149 of the first cleaning component 150 to the second portion 190*b* of the distal end 190 at the first end 201*b* and a second height H2 measured from the bottom end 149 of the first cleaning component 150 to the second portion 190*b* of the distal end 190 at the second end 202*b*. The second height H2 is greater than the first height H1. And this is true for each of the portions 200*a-c* of the first cleaning component 150 (each of the portions 200*a-c* has a greater height at the second end 202*a-c* than at the first end 202*a-c*). In the exemplified embodiment, the first height H1 at the first ends 201*a-c* is the minimum height of each of the portions 200*a-c* and the second height H2 at the second ends 202*a-c* is the maximum height of each of the portions 200*a-c*. The maximum height of each portion 200*a-c* is greater than the minimum height of that same portion 200*a-c* and the minimum height of each of the other portions 200*a-c*. Stated another way, each of the first, second, and third portions 190*a-c* of the distal end 190 of the first cleaning component 150 has a low point LP1, LP2, LP3 at the first end 201*a-c* and a high point HP1, HP2, HP3 at the second end 202*a-c*.

Thus, each of the first, second, and third portions 190*a-c* of the distal end 190 of the first cleaning component 150 is sloped or inclined upwardly from the first end 201*a-c* to the second end 202*a-c*. Thus, the first, second, and third portions 190*a-c* of the distal end 190 of the first cleaning component 150 may be deemed to be sloped portions of the distal end 190. More specifically, in the exemplified embodiment the first portion 190*a* of the distal end 190 lies on a first plane that is oblique to the front surface 121 of the head 120, the second portion 190*b* of the distal end 190 lies on a second plane that is oblique to the front surface 121 of the head 120, and the third portion 190*c* of the distal end 190 lies on a third plane that is oblique to the front surface 121 of the head 120. Each of the first, second, and third planes is distinct from one another. Only the second plane P2-P2 is shown in the drawings, but it should be appreciated that each of the portions 190*a-c* of the distal end 190 lie on a plane oriented at a similar angle as P2-P2. Of course, the first, second, and third portions 190*a-c* of the distal end 190 need not lie in a plane in all embodiments, so long as they are sloped or have a height (measured as a distance to the front surface 121 of the head 120) that increases from the first end 201*a-c* to the second end 202*a-c* as described herein and shown in the drawings.

As used herein, the term sloped does not refer only to a surface which is linear. Rather, the term sloped refers to any surface of which one end or side is at a higher level or elevation than the other end or side. Thus, the surface which is sloped (typically the distal end of a particular cleaning component) may be linear, curved, wave, or the like in some embodiments so long as it is higher at one end than the other. In the exemplified embodiment, the first, second, and third portions 190*a-c* of the distal end 190 may be linear.

The first, second, and third portions 200*a-c* of the first cleaning component 150 are arranged in a ring or loop so that the first end 201*a-c* of each of the arcuate portions 200*a-c* is adjacent to the second end 202*a-c* of another one of the arcuate portions 200*a-c*. More specifically, the first end 201*a-c* of each of the arcuate portions 200*a-c* is abutted against and in direct contact with the second end 202*a-c* of another one of the arcuate portions 200*a-c*. As it pertains to the exemplified embodiment, the second end 202*a* of the first portion 200*a* is adjacent to (and abuts against) the first end 201*b* of the second portion 200*b*, the second end 202*b* of the second portion 200*b* is adjacent to (and abuts against) the first end 201*c* of the third portion 200*c*, and the second end 202*c* of the third portion 202*c* is adjacent to (and abuts against) the first end 201*a* of the first portion 200*a*.

Similarly, this means that the low point LP1-3 of each of the first, second, and third portions 190*a-c* of the distal end 190 is adjacent to the high point HP1-3 of another one of the first, second, and third portions 190*a-c* of the distal end 190. As shown in FIG. 5, the high point HP1 is adjacent to the low point LP2, the high point HP2 is adjacent to the low point LP3, and the high point HP3 is adjacent to the low point LP1. As a result, there is an abrupt change in the height of the first cleaning component 150 at each location where a high point HP1-3 is adjacent to a low point LP1-3. Stated another way, the abrupt change in height occurs at a transition from each of the first, second, and third portions 200*a-c* to each adjacent one of the first, second, and third portions 200*a-c*. Thus, moving circumferentially around the first cleaning component 150, the first cleaning component 150 has an abrupt change in height at a transition from each of the portions 200*a-c* to each adjacent one of the portions 200*a-c*.

The height of each of the portions 200*a-c* of the first cleaning component 150 taken at the second ends 202*a-c* is greater than the height of each of the portions 200*a-c* of the first cleaning element 150 taken at the first ends 201*a-c*. Again, this results in an abrupt change in the height of the first cleaning component 150 as the first cleaning component 150 transitions from one of the portions 200*a-c* to the next. In the exemplified embodiment, the height of each of the portions 200*a-c* of the first cleaning component 150 continually increases from the first end 201*a-c* to the second end 202*a-c* to form the sloped portions 190*a-c* of the distal end 190 of the first cleaning component 150.

Perhaps best shown in FIG. 7, each of the portions 200*a-c* of the first cleaning component 150 forms a part of the outer surface 155 and a part of the inner surface 156 of the first cleaning component 150. The portion of the outer surface 155 formed by the first portion 200*a* is flush with the portion of the outer surface 155 formed by each of the second and third portions 200*b, c* at a transition between the first portion 200*a* and each of the second and third portions 200*b, c*. The portion of the inner surface 156 formed by the first portion 200*a* is flush with the portion of the inner surface 156 formed by each of the second and third portions 200*b, c*. The same is true for each of the adjacent portions 200*a-c*, which ensures that the inner and outer surfaces 155, 156 of the first cleaning component 150 are smooth and flush surfaces including at the transition between the first, second, and third portions 200*a-c*.

As a result of the sloped portions 190*a-c* of the distal end 190 and the arrangement of the portions 200*a-c*, the second end 202*a-c* of each of the portions 200*a-c* has an upper edge portion 203*a-c* that protrudes from the portion 190*a-c* of the distal end 190 of an adjacent one of the portions 200*a-c*. Thus, for example and as shown in FIG. 6, the second end 202*a* of the first portion 200*a* of the first cleaning component 150 has an upper edge portion 203*a* that protrudes from the portion 190*b* of the distal end 190 formed by the second portion 200*b* of the first cleaning component 150. Thus, the upper edge portion 203*a* of the second end 202*a* extends beyond the portion 190*b* of the distal end 190 in a direction of the cavity axis D-D and extends from the portion 190*b* of the distal end 190 to the portion 190*a* of the distal end 190. Similarly, the second end 202*b* of the second portion 200*b* of the first cleaning component 150 has an upper edge portion 203*b* that protrudes from the portion 190*c* of the distal end 190 formed by the third portion 200*c*. Thus, the upper edge portion 203*b* of the second end 202*b* extends beyond the portion 190*c* of the distal end 190 in a direction of the cavity axis D-D and extends from the portion 190*c* of the distal end 190 to the portion 190*b* of the distal end 190. Furthermore, the second end 202*c* of the third portion 200*c* of the first cleaning component 150 has an upper edge portion 203*c* that protrudes from the portion 190*a* of the distal end 190 formed by the first portion 200*a*. Thus, the upper edge portion 203*c* of the second end 202*c* extends beyond the portion 190*a* of the distal end 190 in a direction of the cavity axis D-D and extends from the portion 190*a* of the distal end 190 to the portion 190*c* of the distal end 190. The upper edge portions 203*a-c* are exposed, which makes them available for scrubbing teeth and gums during cleaning.

In one embodiment, the first portion 200*a* of the first cleaning component 150 may comprise or be formed of a first color, the second portion 200*b* of the first cleaning component 150 may comprise or be formed of a second color, and the third portion 200*c* of the first cleaning component 150 may comprise or be formed of a third color. Each of the first, second, and third colors may be different from one another in some embodiments. This includes distinct colors and different visually distinguishable shades of the same color. In other embodiments, each of the first, second, and third colors may be the same.

Referring to FIGS. 8A-8E sequentially, a method of forming the first cleaning component 150 will be described. In the exemplified embodiment, the first cleaning component 150 is formed by inserting three separate picks into one of the tuft holes 141. A pick is a term of art for a grouping of bristles that are grabbed collectively by a toothbrush tufting machine during manufacture. Thus, in many cases a single pick includes all of the bristles for a tuft that is placed into a single tuft hole. However, when forming the first cleaning component 150, there may be multiple picks placed into the same tuft hole 141. As noted above, in the exemplified embodiment there are three picks used to form the first cleaning component 150, although in other embodiments more or less than three picks could be used depending on the technology of the toothbrush tufting machine.

Figure 8A:
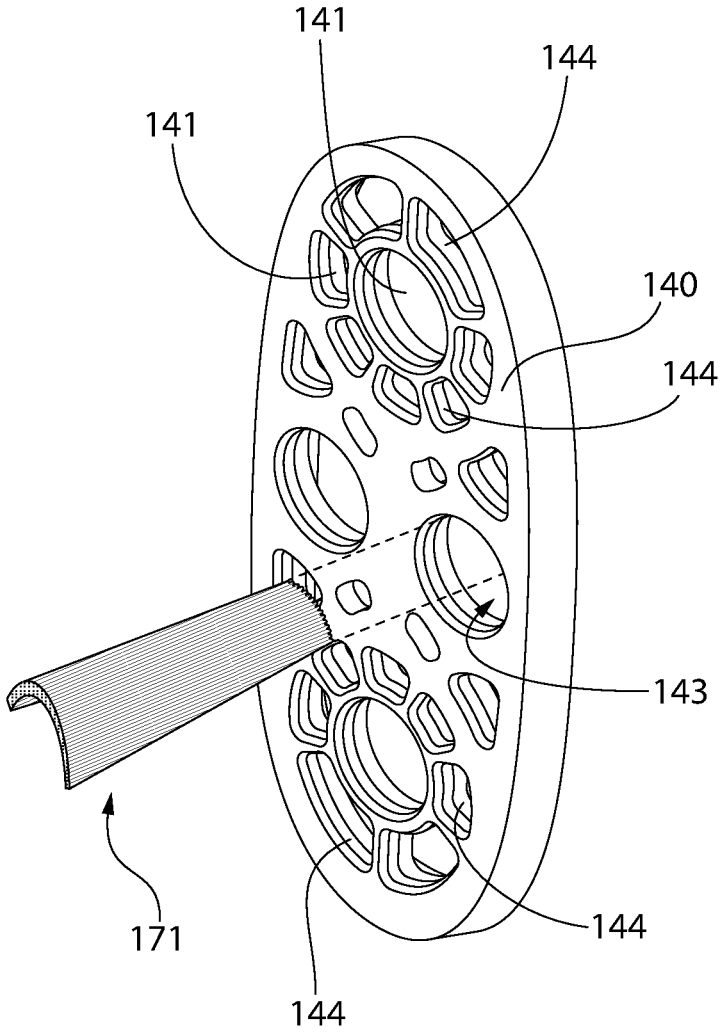
FIGS. 8A-8E illustrate the process of forming the cleaning component of FIG. 5 on a head of an oral care implement in accordance with an embodiment of the present invention.

First, referring to FIG. 8A, the head plate 140 is illustrated having a plurality of tuft holes 141. The plurality of tuft holes 141 includes a first tuft hole 143 which is to be used for retaining the first cleaning component 150. Of course, as mentioned above in other embodiments there could be several tuft holes arranged in a ring or loop and those tuft holes could be used for forming the first cleaning component 150. In the exemplified embodiment, there are a plurality of tuft holes 144 (only some of which are labeled) arranged in a ring or loop, but these tuft holes 144 are used for forming the second cleaning component 160.

Figure 8B:
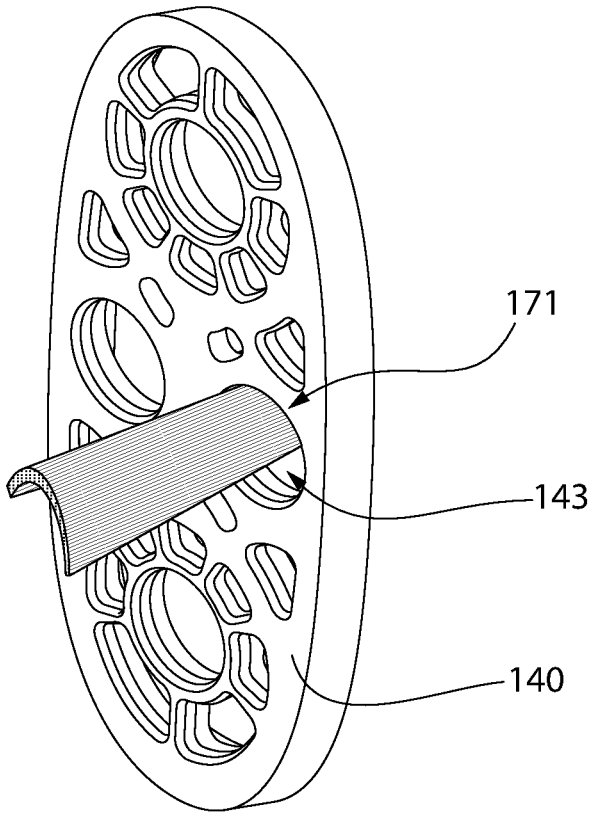

FIG. 8A illustrates a first pick of bristles 171 being placed into the first tuft hole 143. In this embodiment, the first tuft hole 143 is formed into the head plate 140 which is later coupled to the base structure 125 of the head 120 as mentioned above and described below with reference to FIG. 8E. However, the first tuft hole 143 could be formed into the main body of the head 120 in other embodiments if a head plate 140 is to be omitted. FIG. 8B illustrates the first pick of bristles 171 disposed within the first tuft hole 143.

Figure 8C:
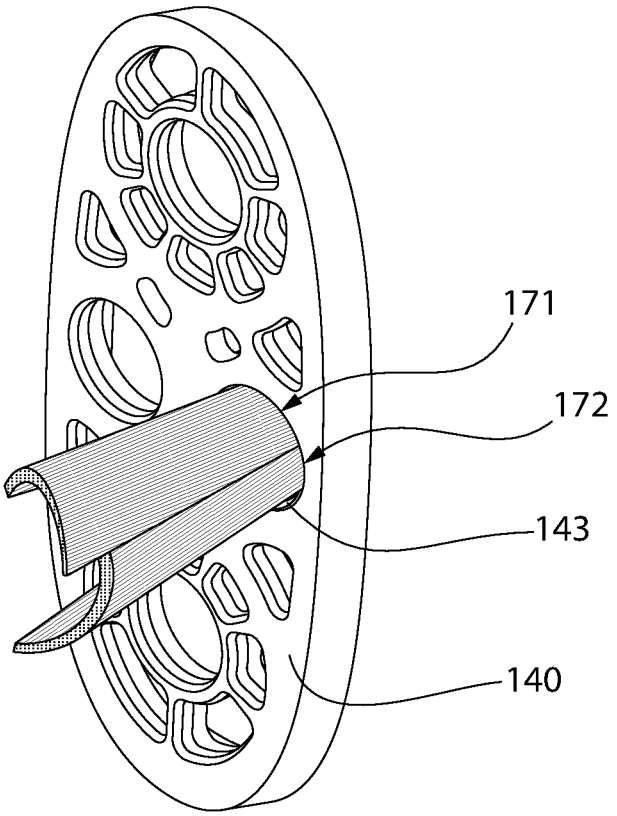

FIG. 8C illustrates the first pick of bristles 171 and a second pick of bristles 172 disposed within the first tuft hole 143. Thus, to get from FIG. 8B to FIG. 8C, the tufting machine picks up the second pick of bristles 172 and places it into the first tuft hole 143 adjacent to the first pick of bristles 171.

Figure 8D:
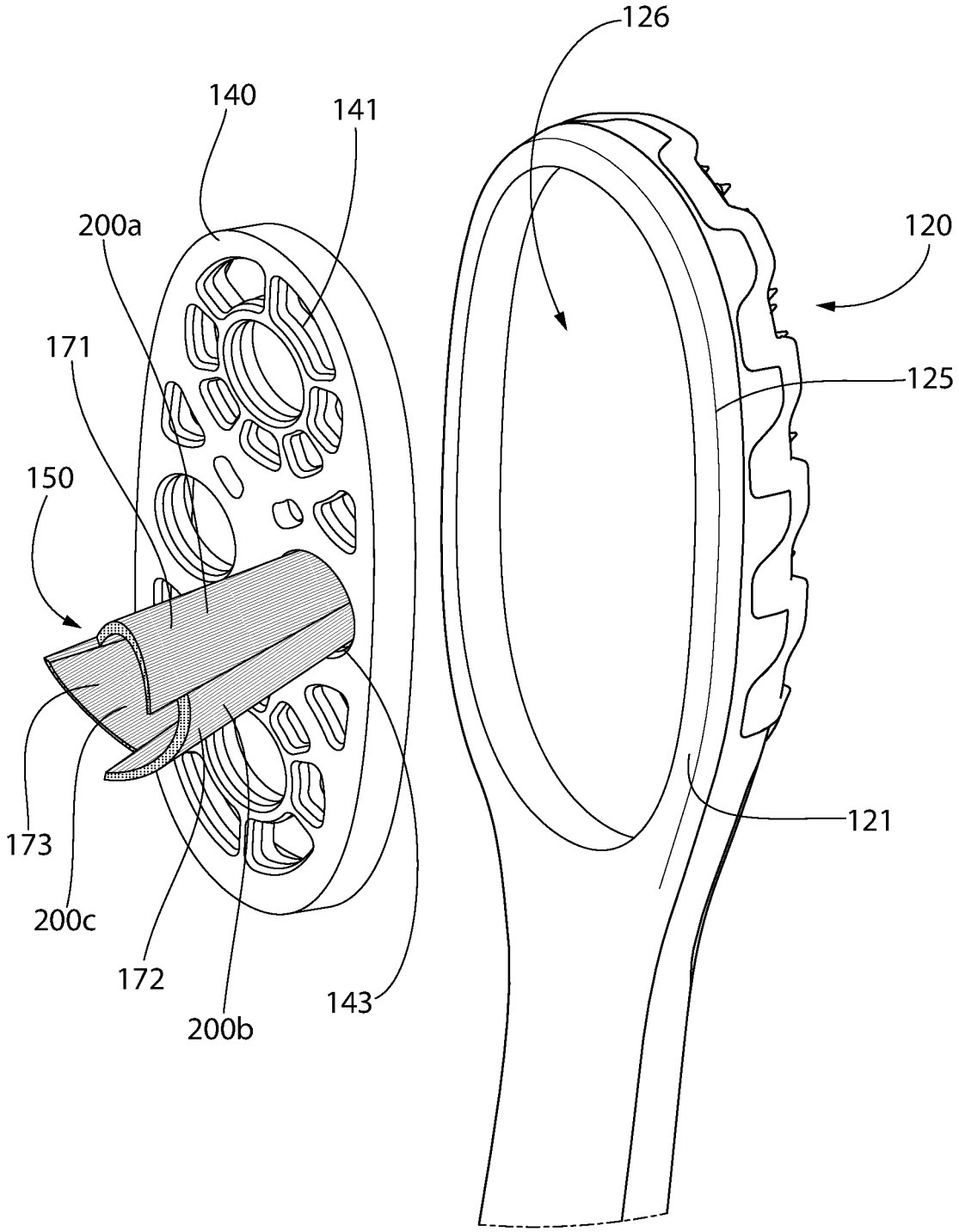

FIG. 8D illustrates the first and second picks of bristles 171, 172 and a third pick of bristles 173 disposed within the first tuft hole 143. The first, second, and third picks of bristles 171, 172, 173 collectively form the first cleaning component 150. The first pick of bristles 171 forms the first portion 200*a* of the first cleaning component 150, the second tuft of bristles 172 forms the second portion 200*b* of the first cleaning component 150, and the third tuft of bristles 173 forms the third portion 200*c* of the first cleaning component 150. Thus, the first, second, and third picks of bristles 171, 172, 173 are arranged in a ring within the first tuft hole 143 so that high points of one pick are adjacent to low points of another pick. This creates the turbine-like appearance of the first cleaning component 150 that has been described herein above.

Figure 8E:
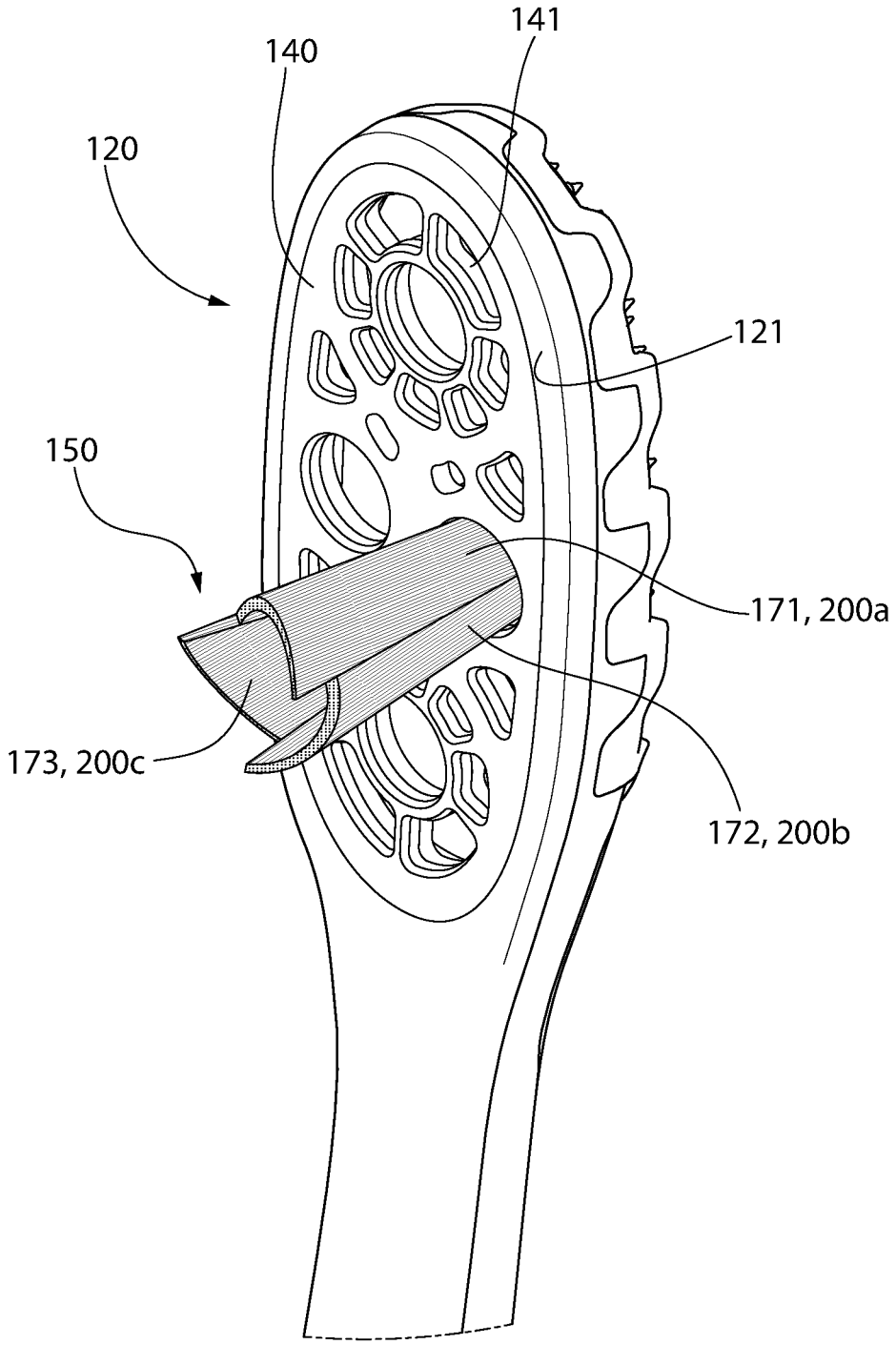

FIG. 8D also illustrates the head plate 140 being adjacent to the base structure 125 of the head 120. Turning to FIG. 8E, the head plate 140 has been inserted into a cavity 129 in the front surface 121 of the base structure 125 of the head 120. The head plate 140 can then be coupled to the base structure 125 to form the head 120 using ultrasonic welding, adhesives, fasteners, interference fit, friction fit, or the like in various different embodiments. In FIGS. 8D and 8E, only the first cleaning component 150 is shown to enhance clarity and understanding. However, it should be appreciated that all of the tuft holes 141 would be filled with bristles and/or other cleaning elements before coupling the head plate 140 to the base structure 125. Furthermore, generally before the head plate 140 is coupled to the base structure 125, the cleaning elements would be heated to form the melt matte on the rear side of the head plate 140 as described previously.

Figure 9A:
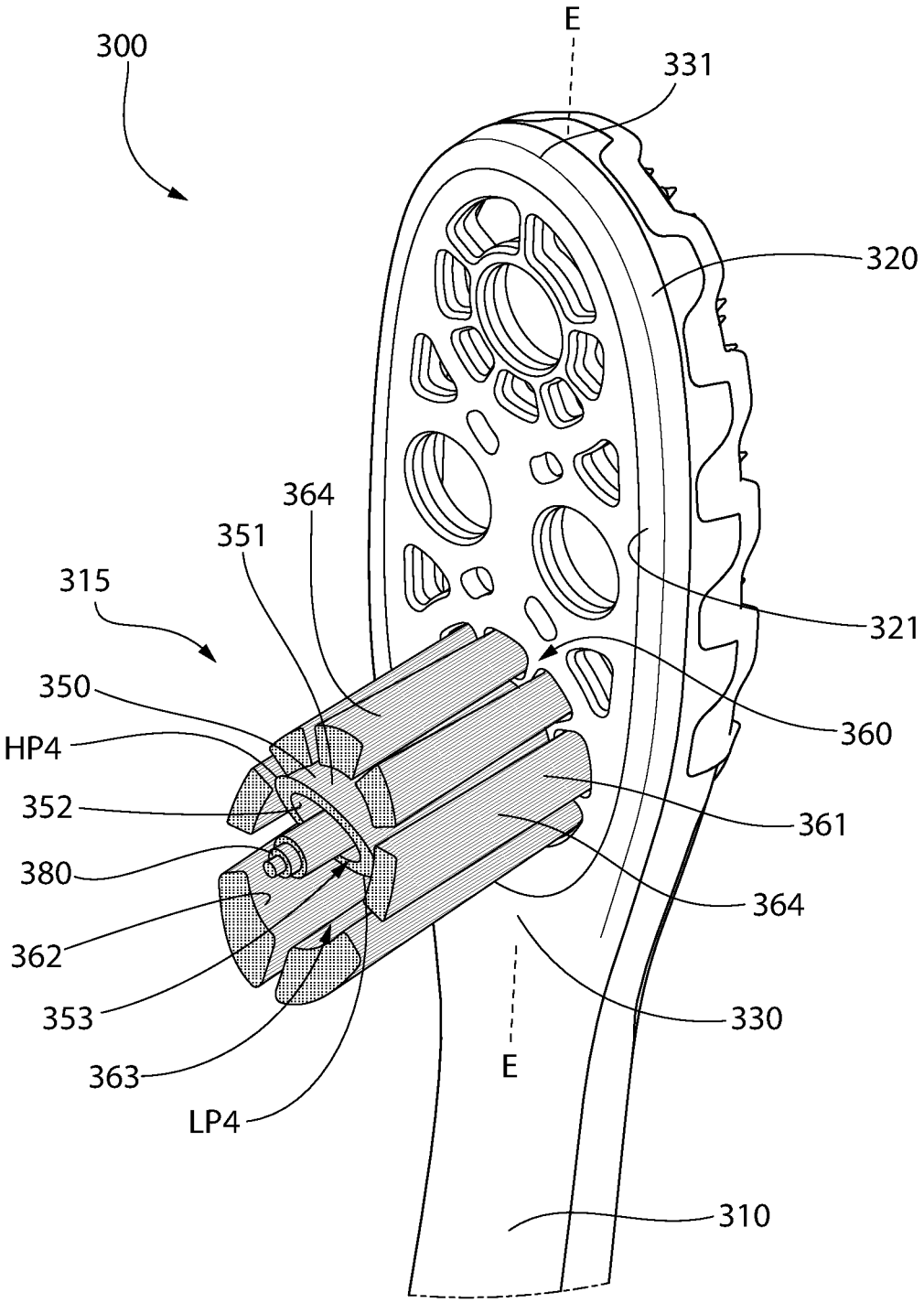
FIG. 9A is a perspective view of a head of an oral care implement with a cleaning component thereon in accordance with another embodiment of the present invention.
Figure 9B:
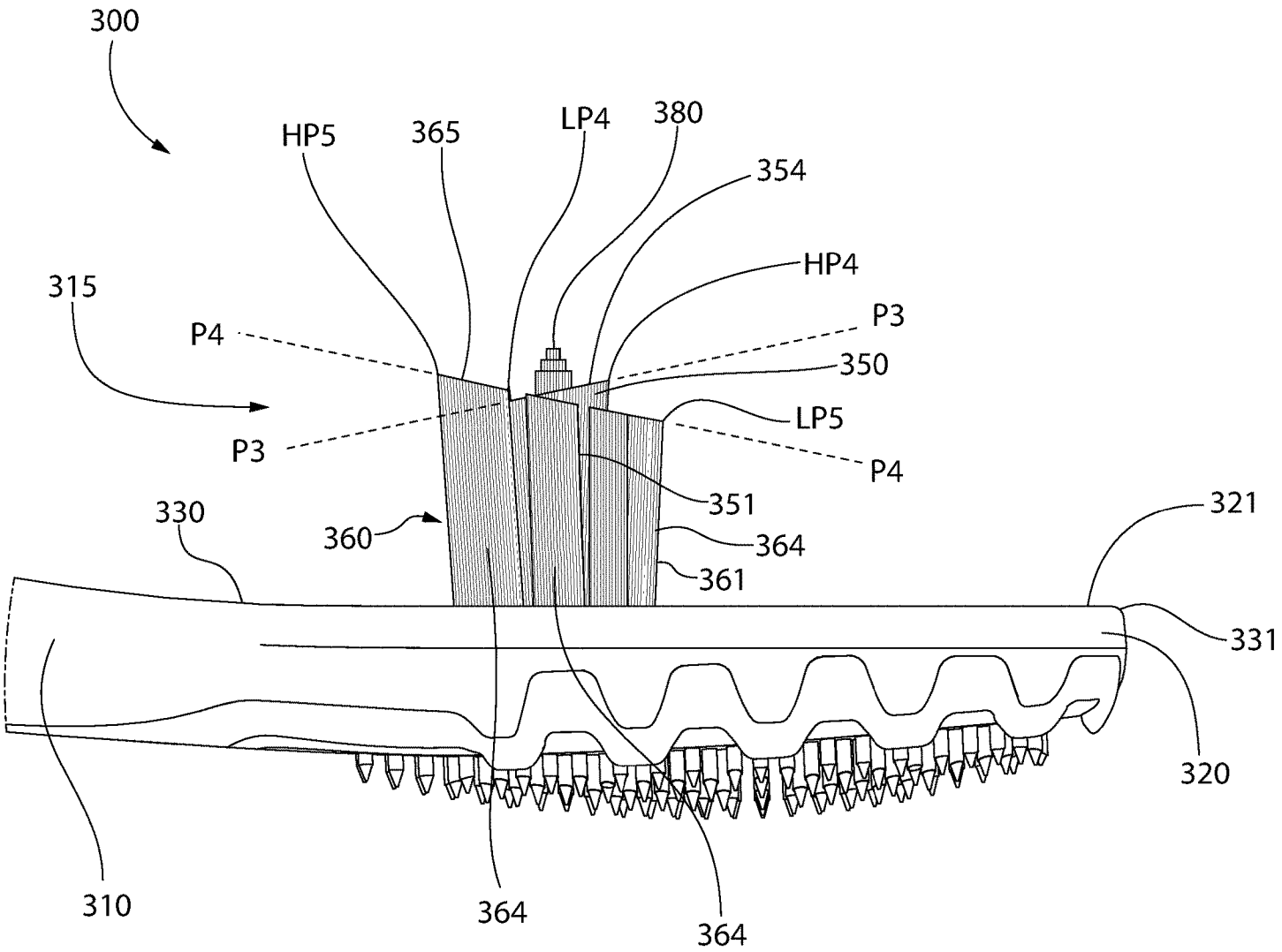
FIG. 9B is a side view of the head of FIG. 9A.

Referring now to FIGS. 9A and 9B, an oral care implement 300 will be described in accordance with another embodiment of the present invention. Many features of the oral care implement 300 are the same as that which was described above with regard to the oral care implement 100 and will not be described in detail herein below. For such features, it should be appreciated that the description of the oral care implement 100 is applicable. In particular, FIGS. 9A and 9B illustrate the oral care implement 300 comprising the handle 310 and the head 320, but only illustrate some of the cleaning elements on the head 320. Additional cleaning elements would be provided on the head 320 in the finished/completed oral care implement 300, such as those shown in relation to the oral care implement 100 and described above. Furthermore, the handle 310 and the head 320 will not be described in detail herein, it being understood that the description of the handle 110 and the head 120 is applicable. However, it will be noted that the head 320 extends from a proximal end 330 to a distal end 331 along a longitudinal axis E-E.

The oral care implement 300 comprises a plurality of cleaning elements 315 extending from the front surface 321 of the head 320 (only some of which are depicted as mentioned above to focus on the inventive concepts). Specifically, the plurality of cleaning elements 315 comprises a first cleaning component 350, a second cleaning component 360, and a central cleaning element 380. The second cleaning component 360 surrounds the first cleaning component 350, and the first cleaning component 350 surrounds the central cleaning element 380.

The first cleaning component 350 is, in the exemplified embodiment, formed from a plurality of bristles that are disposed within a common tuft hole (similar to the first cleaning component 150). The first cleaning component 350 is similar to the first cleaning component 150 in many respects, with the main difference being the profile at the distal end. Thus, the first cleaning component 350 comprises an outer surface 351 and an inner surface 352, with the inner surface 352 defining a cavity 353. The first cleaning component 350 forms a continuous bristle wall such that there is no direct line of sight through the first cleaning component 350 from the outer surface 351 to the inner surface 352. Thus, there are no gaps formed in the continuous bristle wall formed by the first cleaning component 350 in the exemplified embodiment. This is, in part, because the first bristle cleaning component 350 is formed within a single tuft hole as with the first cleaning component 150 described above. However, in alternative embodiments the first cleaning component 350 could be formed by multiple bristle tufts in separate tuft holes, and in such alternative embodiment there would likely be gaps in the bristle wall.

The first cleaning component 350 extends from the front surface 321 of the head 320 to a distal end 354. In the exemplified embodiment, the first cleaning component 350 is annular and has a ring-like shape. Of course, the first cleaning component 350 can take on any of the shapes noted above with regard to the first cleaning component 150, and the term annular should be understood as defined above to include circular, oval, square, rectangular, triangular, and other shapes. The distal end 354 of the first cleaning component 350 is an annular top surface of the first cleaning component 350 and it surrounds an opening into the cavity 353.

In this embodiment, an entirety of the distal end 354 is sloped so as to be inclined from a first low point LP4 to a first high point HP4. In the exemplified embodiment, the first low point LP4 of the distal end 354 is the portion of the distal end 354 located closest to the proximal end 330 of the head 320 and the first high point HP4 of the distal end 354 is the portion of the distal end 354 located closest to the distal end 331 of the head 320, although this could be reversed in other embodiments. In any case, the first low and high points LP4, HP4 are aligned with opposite ends of the first cleaning component 350 that are located on the longitudinal axis E-E of the head 320.

The first cleaning component 350 has a height measured from the front surface 321 of the head 320 to the distal end 354. The height of the first cleaning component 350 continuously increases from the first low point LP4 to the first high point HP4. In the exemplified embodiment, the distal end 354 is continuously sloped so that the entirety of the distal end 354 lies on a plane P3-P3 that is oblique to the longitudinal axis E-E and to the front surface 321 of the head 320. In the exemplified embodiment, the distal end 354 is sloped upwards heading in a direction from the proximal end 330 of the head 320 to the distal end 331 of the head 320. Thus, in the exemplified embodiment the low point LP4 is located closer to the proximal end 330 than the high point HP5. However, in other embodiments the distal end 354 could be sloped downwards heading in the direction from the proximal end 330 to the distal end 331 of the head 320.

Moreover, in some embodiments there may be one of the first cleaning components 350 located adjacent to the proximal end 330 of the head 320 and another of the first cleaning components 350 located adjacent to the distal end 331 of the head 320. In such an embodiment, the first cleaning component 350 adjacent to the proximal end 330 may have its distal end 354 sloped upwards with distance from the proximal end 330 and the first cleaning component 350 adjacent to the distal end 331 may have its distal end 354 sloped upwards with distance from the distal end 331. Of course, in other embodiments this direction of the slope of the distal end 354 may be reversed.

The second cleaning component 360 has an outer surface 361 and an inner surface 362 that defines a cavity 363. The second cleaning component 360 surrounds the first cleaning component 350 such that the first cleaning component 350 is positioned within the cavity 363 of the second cleaning component 360. In the exemplified embodiment, the second cleaning component 360 comprises a plurality of bristle tufts 364 with each of the bristle tufts 364 being disposed within a different tuft hole. Thus, the plurality of bristle tufts 364 of the second cleaning component 360 are arranged in a loop or ring that collectively surrounds the first cleaning component 350. As a result, there are gaps in the second cleaning element 360 from the outer surface 361 to the inner surface 362 and into the cavity 363 which are not present with the first cleaning element 350. In an alternative embodiment, the second cleaning component 360 may be disposed within a single tuft hole as with the first cleaning component 350.

Like the first cleaning component 350, the second cleaning component 360 has an annular or ring-like shape. Of course, this is not limited to a shape having a circular transverse cross-sectional area, but may include oval, rectangle, square, triangular, or the like as described throughout this document. The second cleaning component 360 extends from the front surface 321 of the head 320 to a distal end 365. In the exemplified embodiment, the distal end 365 of the second cleaning component 360 is sloped from a second low point LP5 to a second high point HP5. In the exemplified embodiment, the distal end 365 of the second cleaning component 360 is sloped in an opposite direction than the distal end 354 of the first cleaning component 350. Thus, while the distal end 354 of the first cleaning component 350 is sloped to incline moving from the proximal end 330 to the distal end 331, the distal end 365 of the second cleaning component 360 is sloped to incline moving from the distal end 331 to the proximal end 330. Of course, the opposite arrangement could take place with the distal end 354 sloping to incline from the distal end 331 to the proximal end 330 and the distal end 365 sloping to incline from the proximal end 330 to the distal end 331 in other embodiments. In either case, the distal end 365 of the second cleaning component 360 slopes in an opposite direction than the distal end 354 of the first cleaning component 350. Thus, one of the first and second cleaning components 350, 360 gets taller the further it is from the proximal end 330 of the head 320 and the other of the first and second cleaning elements 350, 360 gets shorter the further it is from the proximal end 330 of the head 320. As a result, the first annular cleaning component 350 is located within the second cavity 363 of the second cleaning component 360 and arranged so that the first low point LP4 is adjacent to the second high point HP5 and the first high point HP4 is adjacent to the second low point LP5.

In the exemplified embodiment, an entirety of the distal end 365 of the second cleaning component 360 lies on a plane P4-P4 that is oblique to the front surface 321 of the head 320. Thus, the entire distal end 365 of the second cleaning component 360 is sloped as described herein. To achieve this, the distal ends of each of the bristle tufts 364 that collectively form the second cleaning component 360 are sloped or inclined in the same direction. Moreover, a height of the second cleaning component 360 continuously decreases with increasing distance from the proximal end 330 of the head 320 towards the distal end 331 of the head 320.

Although the invention has been described above whereby the distal end 354 of the first cleaning component 350 and the distal end 365 of the second cleaning component 360 have continuously sloped surfaces, the invention is not to be so limited in all embodiments. In other embodiments, one of the first and second cleaning components 350, 360 may simply gradually increase in height while the other of the first and second cleaning elements 350, 360 gradually decreases in height when moving in the same direction (i.e., from the proximal end 330 to the distal end 331 of the head 320). Thus, one or both of the distal ends 354, 365 may be stepped surfaces rather than surfaces that are sloped at a continuous angle.

The central cleaning component 380 is located within the cavity 353 of the first cleaning component 350. In the exemplified embodiment, the central cleaning component 380 has a greater height than a maximum height of each of the first and second cleaning components 350, 360. However, in other embodiments the central cleaning component 380 may have a different height that is shorter than the maximum height of one of the first and second cleaning components 350, 360. Furthermore, as perhaps best seen in FIG. 9A, in the exemplified embodiment the inner surface 362 of the second cleaning component 360 may be spaced apart from the outer surface 351 of the first cleaning component 350 by an annular gap that extends along an entirety of a length/height of the first and second cleaning components 350, 360.

Figure 10A:
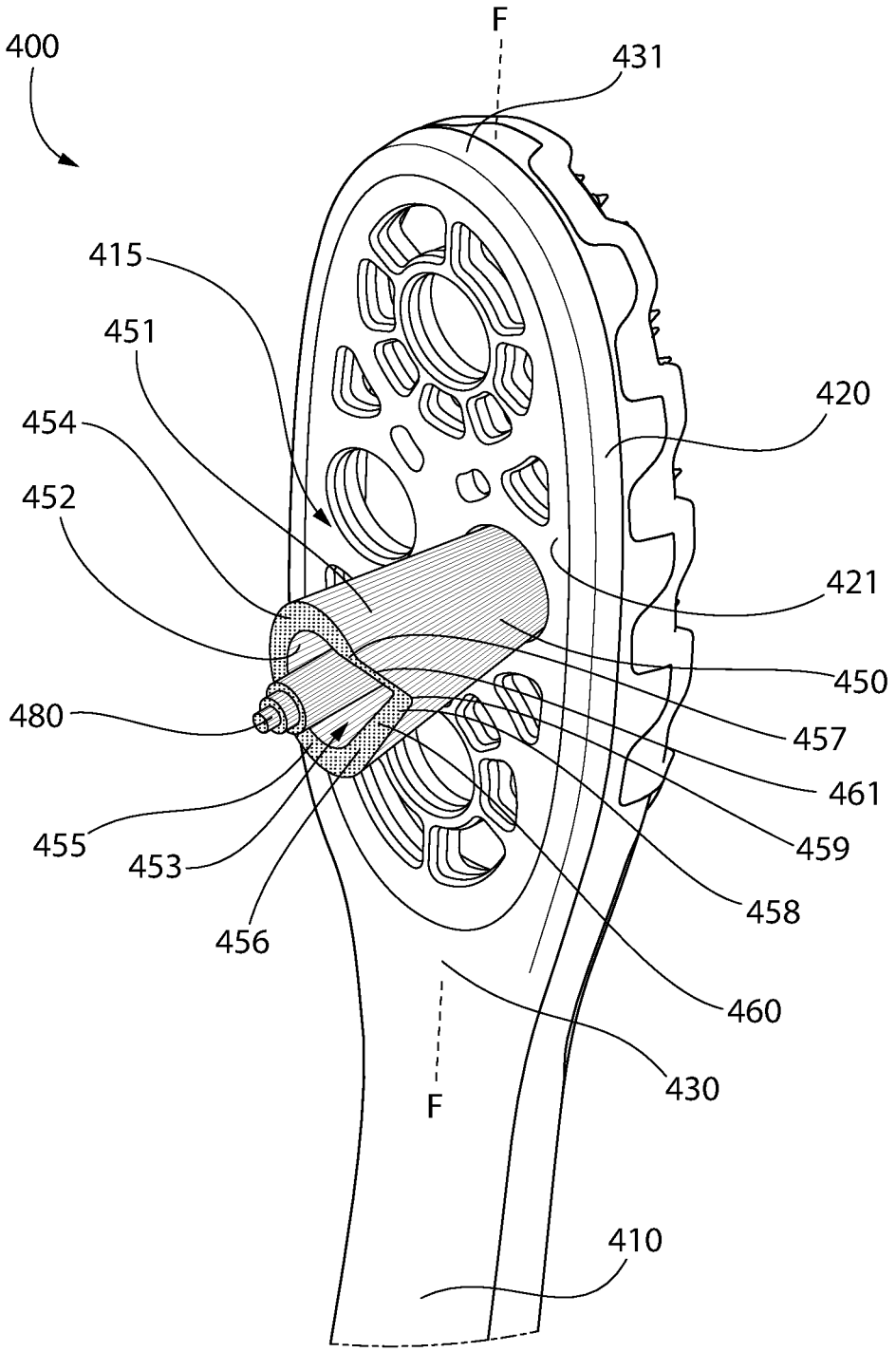
FIG. 10A is a perspective view of a head of an oral care implement with a cleaning component thereon in accordance with yet another embodiment of the present invention.
Figure 10B:
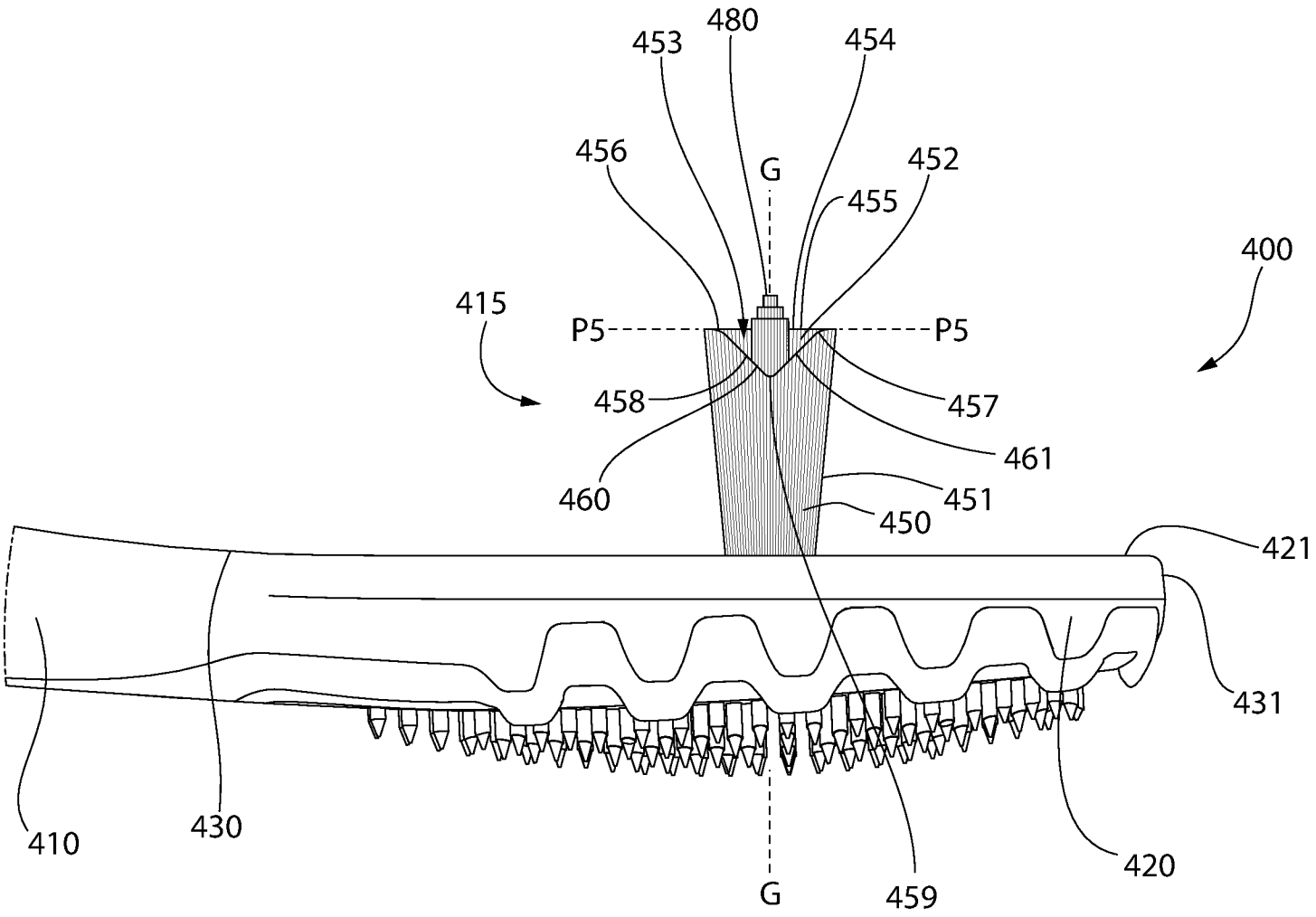
FIG. 10B is a side view of the head of FIG. 10A.

Referring now to FIGS. 10A and 10B, an oral care implement 400 will be described in accordance with an embodiment of the present invention. Many features of the oral care implement 400 are the same as that which was described above with regard to the oral care implement 100 and will not be described in detail herein below. For such features, it should be appreciated that the description of the oral care implement 100 is applicable. In particular, FIGS. 10A and 10B illustrate the oral care implement 400 comprising the handle 410 and the head 420, but only illustrate some of the cleaning elements on the head 420. Additional cleaning elements would be provided on the head 420 in the finished/completed oral care implement 400, such as those shown in relation to the oral care implement 100 and described above. Furthermore, the handle 410 and the head 420 will not be described in detail herein, it being understood that the description of the handle 110 and the head 120 is applicable. However, it will be noted that the head 420 extends from a proximal end 430 to a distal end 431 along a longitudinal axis F-F.

The oral care implement 400 comprises a plurality of cleaning elements 415 extending from the front surface 421 of the head 420 (only some of which are depicted as mentioned above to focus on the inventive concepts). In this embodiment, the plurality of cleaning elements 415 comprise a first cleaning component 450 and a central cleaning element 480 disposed within and surrounded by the first cleaning component 450. The arrangement of the first cleaning component 450 and the central cleaning element 480 is similar to the arrangement of the first cleaning component 150 and the central cleaning element 158 described above, with the main distinction being with regard to the profile of the distal end of the first cleaning component 450.

In that regard, the first cleaning component 450 comprises an outer surface 451 and an inner surface 452, with the inner surface 452 defining or otherwise surrounding a cavity 453 that extends along a cavity axis G-G. In the exemplified embodiment, the first cleaning component 450 is disposed within a single tuft hole as with the first cleaning component 150 described above. Furthermore, the first cleaning component 450 has an annular or ring-like shape, with the term annular taking on the definition provided herein and not being limited to a circular shape, but also including oval, square, rectangular, triangular, or the like shapes. In the exemplified embodiment, the central cleaning element 480 is positioned within the cavity 453 of the first cleaning component 450 so that the first cleaning component 450 surrounds the central cleaning element 480. The central cleaning element 480 is taller than the first cleaning component 450 in the exemplified embodiment, but in other embodiments the central cleaning element 480 may be shorter than the first cleaning component 450.

The first cleaning component 450 extends from the front surface 421 of the head 420 to a distal end 454. In the exemplified embodiment, the distal end 454 is an annular surface and may be described herein as being an annular top surface of the first cleaning component 450. The distal end 454 of the first cleaning component 450 comprises a first portion 455 extending from a first end 456 to a second end 457 and a second portion 458 that extends between the first and second ends 456, 457 of the first portion 455. In the exemplified embodiment wherein the distal end 454 is a circular annular shape, the first portion 455 extends circumferentially from the first end 456 to the second end 457. In the exemplified embodiment, the first portion 455 of the distal end 454 of the first cleaning component 450 lies on a plane P5-P5. Furthermore, in the exemplified embodiment the plane P5-P5 is parallel to the front surface 421 of the head 420 such that the bristles that form the first portion 455 of the distal end 454 all have the same length. However, the plane P5-P5 may be oblique to the front surface 421 of the head 420 in other embodiments.

The second portion 458 of the distal end 454 is located on a first side of the plane P5-P5 between the plane P5-P5 and the front surface 421 of the head 420. Thus, the second portion 458 of the distal end 454 is at a lower elevation than the first portion 455 of the distal end 454. This is due to the bristles forming the second portion 458 of the distal end 454 being shorter than the bristles forming the first portion 455 of the distal end 454. In the exemplified embodiment, the second portion 458 of the distal end 454 is formed by a V-shaped notch formed into the first cleaning component 450. Of course, a notch having other shapes, such as a U-shaped notch or any other shape, may also be used to form the second portion 458 of the distal end 454. While a first portion of the first cleaning component 450 that comprises the first portion 455 of the distal end 454 has a constant height, in the exemplified embodiment a second portion of the first cleaning component 450 that comprises the second portion 458 of the distal end 454 has a non-constant length.

In the exemplified embodiment, the second portion 458 of the distal end 454 comprises a low point 459. Furthermore, the second portion 458 of the distal end 454 comprises a first sloped portion 460 that is sloped upwardly from the low point 459 to the first end 456 of the first portion 455 of the distal end 454 and a second sloped portion 461 that is sloped upwardly from the low point 459 to the second end 457 of the first portion 455 of the distal end 454.

The first cleaning component 450 is symmetric with respect to a first plane that is perpendicular to the front surface 421 of the head 420 (i.e., a plane that intersects the low point 459) and asymmetric with respect to a second plane that is perpendicular to the front surface 421 of the head 420 and perpendicular to the first plane.

Figure 11A:
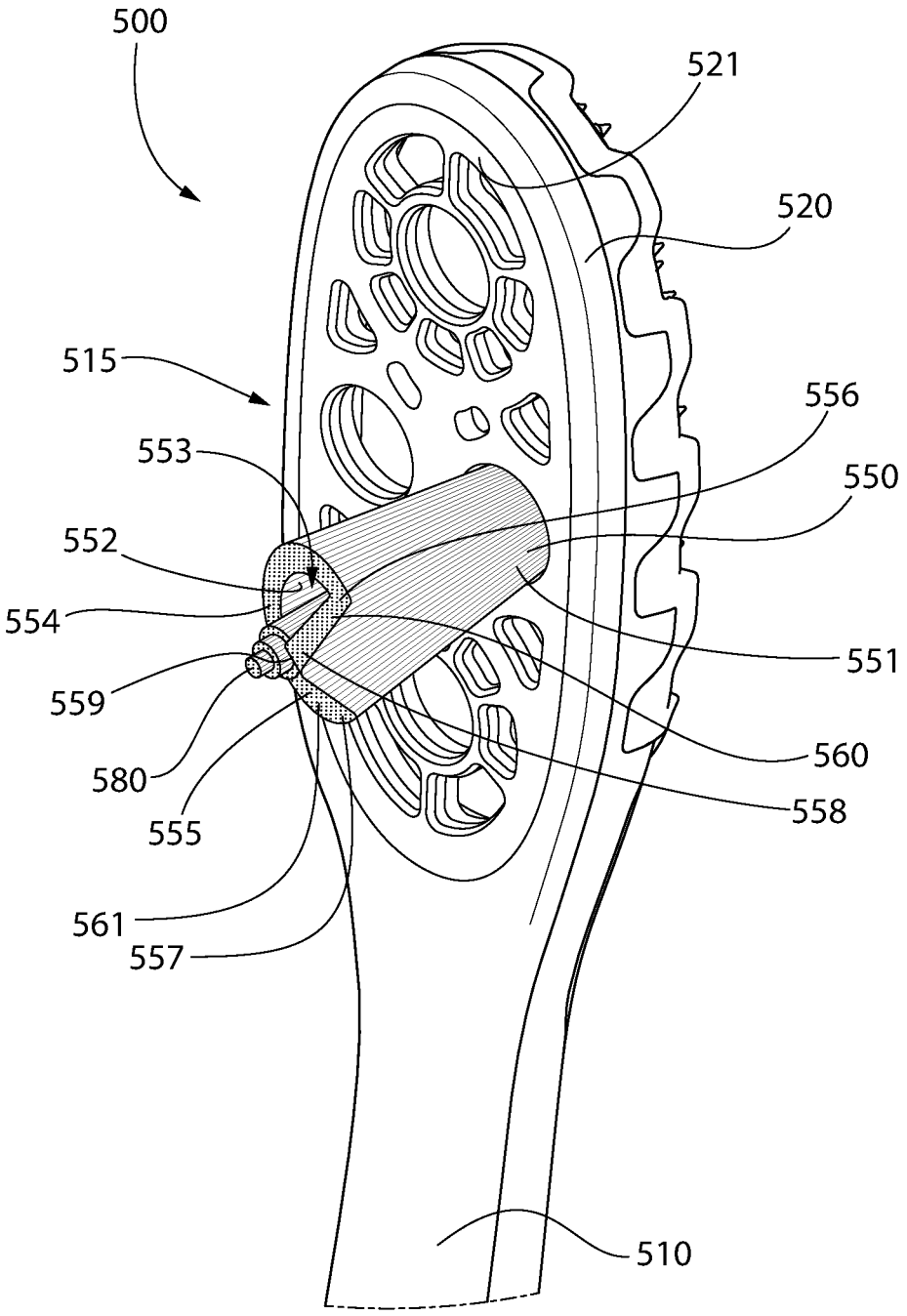
FIG. 11A is a perspective view of a head of an oral care implement with a cleaning component thereon in accordance with still another embodiment of the present invention.
Figure 11B:
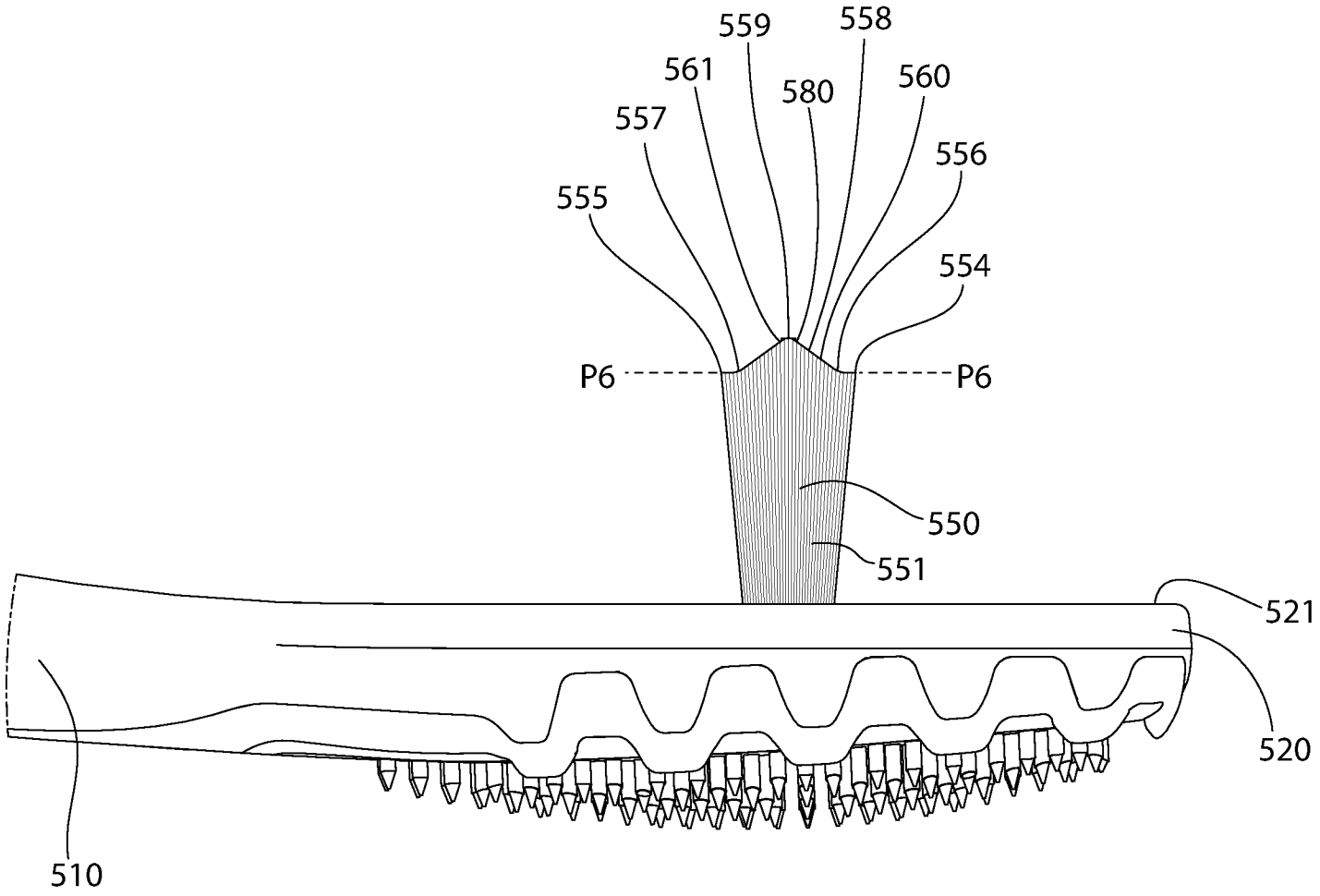
FIG. 11B is a side view of the head of FIG. 11A.

Referring to FIGS. 11A and 11B, an oral care implement 500 is illustrated in accordance with another embodiment. The oral care implement 500 comprises a handle 510 and a head 520 that are identical to the handle 110 and the head 120 described above. The oral care implement 500 comprises a plurality of cleaning elements 515 extending from a front surface 521 of the head 520. The plurality of cleaning elements 515 comprise a first cleaning component 550 and a central cleaning component 580 located within a cavity of the first cleaning component 550. The first cleaning component 550 of the oral care implement 500 is very similar to the first cleaning component 450 of the oral care implement 400, and thus much of the disclosure of the first cleaning component 450 is relevant and can be relied upon.

The first cleaning component 550 comprises an outer surface 551 and an inner surface 552 that defines a cavity 553. The central cleaning element 580 is disposed within the cavity 553 of the first cleaning component 550. The first cleaning component 550 may comprise a plurality of bristles that are disposed within a single tuft hole as has been described above in the other embodiments. Furthermore, the first cleaning component 550 may be annular and have a ring-like shape such that the bristles thereof are arranged in a ring or loop. The first cleaning component 550 extends from the front surface 521 of the head 520 to a distal end 554. The distal end 554 may be annular in some embodiments and may be referred to as an annular top surface of the first cleaning component 550.

The distal end 554 of the first cleaning component 550 comprises a first portion 555 that extends circumferentially from a first end 556 to a second end 557 and a second portion 558 that extends between the first and second ends 556, 557 of the first portion 555. Like with the first cleaning component 450, in this embodiment the first portion 555 of the distal end 554 lies on a plane P6-P6. In the exemplified embodiment, the plane P6-P6 is parallel to the front surface 521 of the head 520, but it may be oblique to the front surface 521 of the head 520 in other embodiments.

In this embodiment, the second portion 558 of the distal end 554 protrudes from the plane P6-P6 such that the second portion 558 of the distal end 554 is located on the side of the plane P6-P6 that faces away from the front surface 521 of the head 520. In the exemplified embodiment, the second portion 558 of the distal end 554 forms a V-shaped extension that protrudes from the first portion 555 of the distal end 554. The second portion 558 of the distal end 554 comprises a high point 559, a first sloped portion 560 extending downwardly from the high point 559 to the first end 556 of the first portion 555 of the distal end 554, and a second sloped portion 561 extending downwardly from the high point 559 to the second end 557 of the first portion 555 of the distal end 554. Similar to the first cleaning component 450, the first cleaning component 550 is symmetric with respect to a first plane that is perpendicular to the front surface 521 of the head 520 and that intersects the high point 559 and non-symmetric with respect to a second plane that is perpendicular to the front surface 521 of the head 520 and to the first plane.

It should be noted here that the cavities 353, 453, 553 of the first cleaning components 350, 450, 550 may be conical in some embodiments. Specifically, the cavities 353, 453, 553 of the first cleaning components 350, 450, 550 may have transverse cross-sectional areas that continually increase with increasing distance from the front surface 321, 421, 521 of the head 320, 420, 520.

Figure 12A:
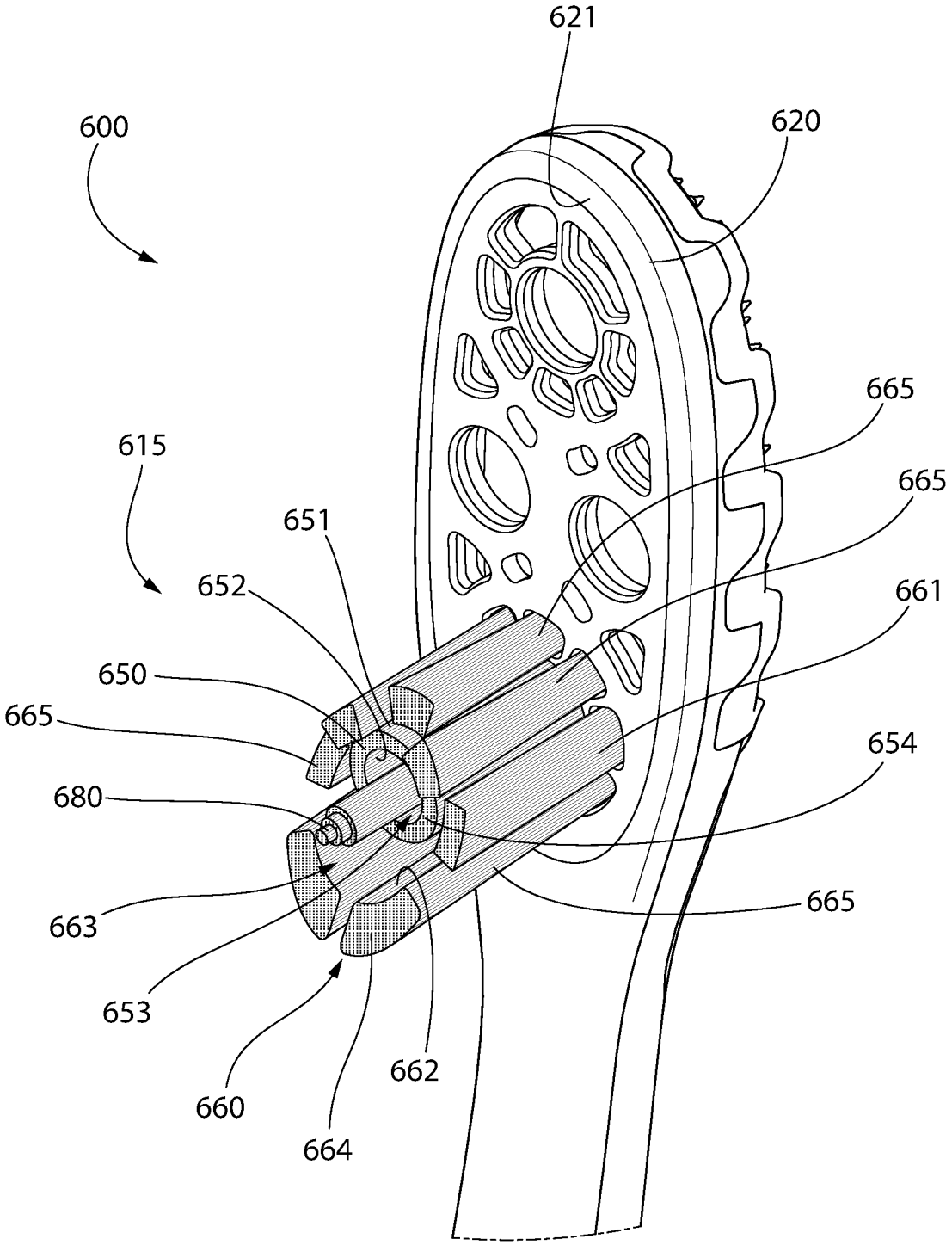
FIG. 12A is a perspective view of a head of an oral care implement with a cleaning component thereon in accordance with a further embodiment of the present invention.
Figure 12B:
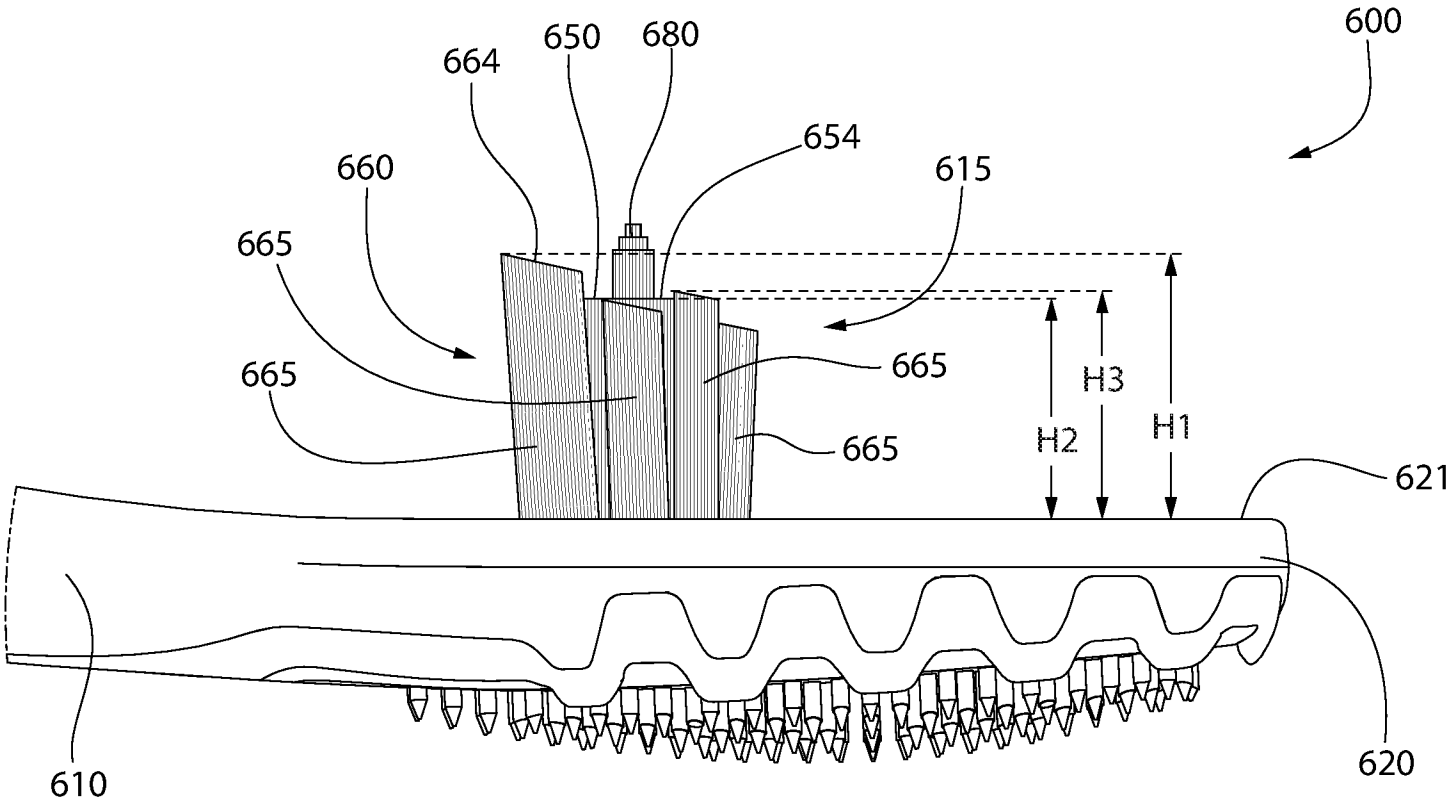
FIG. 12B is a side view of the head of FIG. 12A.

Referring to FIGS. 12A and 12B, an oral care implement 600 will be described in accordance with an embodiment of the present invention. Many features of the oral care implement 600 are the same as that which was described above with regard to the oral care implement 100 and will not be described in detail herein below. For such features, it should be appreciated that the description of the oral care implement 100 is applicable. In particular, FIGS. 12A and 12B illustrate the oral care implement 6 comprising the handle 610 and the head 620, but only illustrate some of the cleaning elements on the head 620. Additional cleaning elements would be provided on the head 620 in the finished/completed oral care implement 600, such as those shown in relation to the oral care implement 100 and described above. Furthermore, the handle 610 and the head 620 will not be described in detail herein, it being understood that the description of the handle 110 and the head 120 is applicable.

The plurality of cleaning elements 615 comprises a first cleaning component 650, a second cleaning component 660, and a central cleaning element 680. In this embodiment, the first cleaning component 650, the second cleaning component 660, and the central cleaning element 680 each comprise a plurality of bristles. However, in other embodiments the first cleaning component 650, the second cleaning component 660, and/or the central cleaning element 680 may comprise an elastomeric element instead of or in addition to the bristles.

In this embodiment, the first cleaning component 650 is an annular component having an outer surface 651 and an inner surface 652 that defines a cavity 653. The central cleaning element 680 is disposed within the cavity 653 of the first cleaning component 650. The first cleaning component 650 and the central cleaning element 680 may be disposed within a single tuft hole as has been described above. In other embodiments, the first cleaning component 650 may be formed from several tufts of bristles disposed in distinct tuft holes and the central cleaning component 680 may also be disposed within its own tuft hole. Moreover, the central cleaning component 680 could be omitted in some embodiments.

In the exemplified embodiment, the first cleaning component 650 extends from the front surface 621 of the head 620 to a distal end 654. The distal end 654 may be annular and may be referred to herein as an annular top surface. In the exemplified embodiment, the distal end 654 is planar and lies on a plane that is parallel to the front surface 621 of the head 620. However, the invention is not to be so limited in all embodiments and the distal end 654 may be inclined or sloped so as to lie on a plane that is oblique to the front surface 621 of the head 620 in other embodiments. In still other embodiments, the distal end 654 may not be planar but may have various other contours or profiles. The cavity 653 of the first cleaning component 650 may have a conical shape such that the transverse cross-sectional area of the cavity 653 increases with increasing distance from the front surface 621 of the head 620 towards the distal end 654.

The second cleaning component 660 is also annular in shape. However, the second cleaning component 660 comprises a plurality of bristle tufts 665 that are disposed within distinct tuft holes in the front surface 621 of the head 620. This is comparable to the structure of the second cleaning component 360 described above with reference to FIGS. 9A and 9B and the description of the second cleaning component 360 is applicable to the second cleaning component 660 except with respect to the differences noted herein.

The second cleaning component 660 has an outer surface 661 and an inner surface 662 that defines a cavity 663. The first cleaning component 650 is located within the cavity 663 of the second cleaning component 660. The second cleaning component 660 extends from the front surface 621 of the head 620 to a distal end 664. In this embodiment, the distal end 664 of the second cleaning component 660 is non-planar. Rather, the distal end 664 of the second cleaning component 660 has a non-planar stepped profile that is formed due to the various bristle tufts 665 that collectively form the second cleaning component 660 having varying or differing heights from one another.

In the exemplified embodiment, many of the bristle tufts 665 that are forming the second cleaning component 660 have different heights from one another, with the heights all being measured from the front surface 621 of the head 620 to the distal end 664 of the second cleaning component 660. Thus, for example, a first one of the bristle tufts 665 may have a first height H1, a second one of the bristle tufts 665 may have a second height H2, and a third one of the bristle tufts 665 may have a third height H3, with each of the first, second, and third height H1, H2, H3 being the same. In one embodiment, each bristle tuft 665 is either adjacent to two bristle tufts 665 that are taller than it or two bristle tufts 665 that are shorter than it. However, many different permutations in the height variation are possible in other embodiments. In the exemplified embodiment, at least one of the bristle tufts 665 is taller than the maximum height of the first cleaning component 650 and at least one of the bristle tufts 665 is shorter than the maximum height of the first cleaning component 650.

Although in the exemplified embodiment the second cleaning component 660 is formed from distinct bristle tufts 665 positioned within distinct tuft holes, in other embodiments the second cleaning component 660 could be formed in a single tuft hole as has been described herein. The height of the second cleaning component 660 can be varied to achieve a similar non-planar stepped profile at the distal ends 664 as is being achieved in the exemplified embodiment.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a head having a front surface, a first tuft hole formed in the front surface of the head and a plurality of second tuft holes formed in the front surface of the head that collectively surround the first tuft hole;

a plurality of cleaning elements extending from the front surface of the head, the plurality of cleaning elements comprising:

a first annular cleaning component comprising a first inner surface defining a first cavity, the first annular cleaning component having a first distal end that is sloped from a first low point to a first high point, and the first annular cleaning component comprising a first tuft of bristles disposed within the first tuft hole;

a second annular cleaning component comprising a second inner surface defining a second cavity, the second annular cleaning component having a second distal end that is sloped from a second low point to a second high point, and the second annular cleaning component comprising a plurality of tufts of bristles;

wherein the first annular cleaning component is located within the second cavity of the second annular cleaning component, and wherein the first and second distal ends are sloped in opposite directions; and wherein each of the plurality of tufts of bristles of the second annular cleaning component disposed within a different one of the plurality of the second tuft holes.

2. The oral care implement according to claim 1 wherein the first distal end lies on a first plane that is oblique to the front surface of the head and the second distal end lies on a second plane that is oblique to the front surface of the head.

3. The oral care implement according to claim 1 further comprising a central cleaning element located within the first cavity of the first annular cleaning component.

4. The oral care implement according to claim 1 wherein the first annular cleaning component forms a continuous bristle wall that is free of gaps so that no direct line of sight exists from an outer surface to an inner surface of the first annular cleaning component.

5. The oral care implement according to claim 4 wherein the second annular cleaning component comprises a plurality of spaced apart bristle tufts such that gaps exist between each pair of adjacent ones of the bristle tufts of the second annular cleaning component.

6. The oral care implement according to claim 1 wherein the first high point is located closer to a distal end of the head than the first low point, and wherein the second low point is located closer to the distal end of the head than the second high point.

7. The oral care implement according to claim 1 wherein the first distal end forms an annular top surface of the first annular cleaning component and the second distal end forms an annular top surface of the second annular cleaning component.

8. The oral care implement according to claim 1 wherein the second inner surface of the second annular cleaning component is spaced apart from an outer surface of the first annular cleaning component by an annular gap along an entirety of a length of the first and second annular cleaning components.

9. An oral care implement comprising:

a head having a front surface;

a plurality of cleaning elements extending from the front surface of the head, the plurality of cleaning elements comprising:

a first annular cleaning component comprising a first inner surface defining a first cavity, the first annular cleaning component having a first distal end that is sloped from a first low point to a first high point;

a second annular cleaning component comprising a second inner surface defining a second cavity, the second annular cleaning component having a second distal end that is sloped from a second low point to a second high point;

wherein the first annular cleaning component is located within the second cavity of the second annular cleaning component, and wherein the first and second distal ends are sloped in opposite directions;

wherein the first annular cleaning component forms a continuous bristle wall that is free of gaps so that no direct line of sight exists from an outer surface to an inner surface of the first annular cleaning component; and wherein the second annular cleaning component comprises a plurality of spaced apart bristle tufts such that gaps exist between each pair of adjacent ones of the bristle tufts of the second annular cleaning component.

* * * * *